US010328741B2

(12) United States Patent
Loree et al.

(10) Patent No.: US 10,328,741 B2
(45) Date of Patent: Jun. 25, 2019

(54) BINDER

(71) Applicant: CCL Label, Inc., Framingham, MA (US)

(72) Inventors: Dale Loree, Brea, CA (US); Jim Warner, Chicago, IL (US)

( * ) Notice: Subject to any disclaimer, the term of this patent is extended or adjusted under 35 U.S.C. 154(b) by 178 days.

(21) Appl. No.: 15/144,203

(22) Filed: May 2, 2016

(65) Prior Publication Data

US 2016/0243878 A1 Aug. 25, 2016

Related U.S. Application Data

(63) Continuation of application No. 13/672,613, filed on Nov. 8, 2012, now Pat. No. 9,327,543.

(51) Int. Cl.

| | |
|---|---|
| ***B42F 13/00*** | (2006.01) |
| ***B42D 3/00*** | (2006.01) |
| ***B42F 7/00*** | (2006.01) |
| ***B42F 7/02*** | (2006.01) |
| ***B42F 7/06*** | (2006.01) |

(52) U.S. Cl.

CPC ..... *B42F 13/002* (2013.01); *B42D 3/00* (2013.01); *B42F 7/02* (2013.01); *B42F 7/025* (2013.01); *B42F 7/06* (2013.01); *B42F 7/065* (2013.01); *B42F 13/004* (2013.01); *B42F 13/0006* (2013.01); *B42F 13/0013* (2013.01); *Y10T 29/49826* (2015.01)

(58) Field of Classification Search

CPC ..... B42F 13/0006; B42F 13/002; B42F 7/02; B42F 7/06; B42D 3/00

USPC ..... 402/73–74, 76–78; 412/3, 17

See application file for complete search history.

(56) References Cited

U.S. PATENT DOCUMENTS

| | | | |
|---|---|---|---|
| 1,865,741 | A | 7/1932 | Carney |
| 2,421,503 | A | 6/1947 | Hermon |
| 4,630,843 | A | 12/1986 | Willat |
| 4,932,520 | A | 6/1990 | Ciarcia |
| D312,277 | S | 11/1990 | Moor |
| 5,222,825 | A | 6/1993 | Wyant |
| 5,368,333 | A | 11/1994 | Arroyo |
| 5,607,246 | A | 3/1997 | Podosek |
| 5,857,797 | A | 1/1999 | Streff |
| 5,876,143 | A | 3/1999 | Ong |

(Continued)

FOREIGN PATENT DOCUMENTS

| | | | |
|---|---|---|---|
| CA | 2198056 | C | 10/2000 |
| CA | 2341057 | A1 | 9/2001 |

(Continued)

OTHER PUBLICATIONS

CN-202878970-U Abstract (Year: 2013).*

(Continued)

*Primary Examiner* — Kyle R Grabowski

(74) *Attorney, Agent, or Firm* — McDonald Hopkins LLC

(57) ABSTRACT

A binder including a front cover including a front cover exterior layer, a front cover interior layer, a front cover base plate between the front cover exterior layer and the front cover interior layer, an exterior pocket formed between the front cover exterior layer and the front cover base plate, and an interior opening formed through the front cover interior layer and the front cover base plate to the exterior pocket. Methods of manufacturing the binder are also disclosed.

14 Claims, 36 Drawing Sheets

(56) References Cited

U.S. PATENT DOCUMENTS

| | | | |
|---|---|---|---|
| 5,944,352 | A | 8/1999 | Crouch |
| 5,951,189 | A | 9/1999 | Winzen |
| 5,951,190 | A | 9/1999 | Wilson |
| 6,017,164 | A | 1/2000 | Abbott |
| 6,024,508 | A | 2/2000 | Lippeth |
| 6,036,229 | A | 3/2000 | Peleman |
| 6,045,160 | A | 4/2000 | Weeks |
| 6,045,161 | A | 4/2000 | Ashcraft |
| 6,196,591 | B1 | 3/2001 | Lieth |
| 6,206,602 | B1 | 3/2001 | Yamamoto |
| 6,213,516 | B1 | 4/2001 | Ong |
| 6,234,701 | B1 | 5/2001 | Karten |
| 6,361,236 | B1 | 3/2002 | Podosek |
| 6,364,559 | B2 | 4/2002 | Brown |
| 6,368,005 | B1 | 4/2002 | Streff |
| 6,488,433 | B2 | 12/2002 | Wien |
| 6,764,242 | B1 | 7/2004 | Karten |
| 7,021,853 | B2 | 4/2006 | Hall |
| 7,140,643 | B1 | 11/2006 | Smith |
| 7,320,554 | B2 | 1/2008 | Hough |
| D565,099 | S | 3/2008 | Petrie |
| 7,387,461 | B2 | 6/2008 | Brandt |
| 7,399,136 | B2 | 7/2008 | Petrie |
| D576,673 | S | 9/2008 | Petrie |
| 7,717,639 | B2 | 5/2010 | Zins |
| 7,762,589 | B2 | 7/2010 | Hough |
| 7,934,884 | B2 | 5/2011 | Lockhart |
| 2005/0053417 | A1 | 3/2005 | Yamamoto |
| 2005/0100395 | A1 | 5/2005 | Brann |
| 2006/0055167 | A1 | 3/2006 | Pollman |
| 2008/0226384 | A1 | 9/2008 | Shing |
| 2008/0273917 | A1 | 11/2008 | Beuselinck |
| 2009/0236843 | A1 | 9/2009 | Rowe |
| 2011/0038662 | A1 | 2/2011 | Lockhart |
| 2011/0206446 | A1 | 8/2011 | Lockhart |
| 2012/0080876 | A1 | 4/2012 | Bowers |
| 2012/0082505 | A1 | 4/2012 | Sada |
| 2012/0087714 | A1 | 4/2012 | Chang |

FOREIGN PATENT DOCUMENTS

| | | | | |
|---|---|---|---|---|
| CA | 2514032 | A1 | | 8/2004 |
| CA | 2347878 | C | | 3/2005 |
| CA | 2543332 | A1 | | 10/2006 |
| CA | 2343770 | C | | 11/2006 |
| CA | 2629975 | A1 | | 7/2007 |
| CA | 2344649 | C | | 3/2008 |
| CA | 2665586 | A1 | | 4/2008 |
| CA | 2619106 | A1 | | 7/2008 |
| CA | 2314550 | C | | 12/2008 |
| CA | 2663480 | A1 | | 10/2009 |
| CA | 2376539 | C | | 3/2010 |
| CA | 2765109 | A1 | | 12/2010 |
| CA | 2462705 | C | | 10/2011 |
| CA | 2478972 | C | | 11/2011 |
| CN | 202878970 | U | * | 4/2013 |

OTHER PUBLICATIONS

Canadian Industrial Designs Database CA ID117894, Date of Registration Mar. 19, 2008, Title Binder, 2 pages.—located in parent case.

Canadian Industrial Designs Database CA ID120892, Date of Registration: Mar. 19, 2008, Title Binder, 1 page.—located in parent case.

Chikanari, K., et al., Characteristics and Applications of Sumitomo Easy Processing Polyethylene, Sumitomo Chemical Co., Ltd., Petrochemicals Research Laboratory, 2006, pp. 1-9.—located in parent case.

Sumitomo Chemical Asia, Grade List Summary, Jan. 1, 2010, 2 pages.—located in parent case.

Webpage screen shot of KYSH, Dongguan Kaiyuan Plastication Technology Co., Ltd., 2 pages.—located in parent case.

Webpage screen shot of Binders.com, Binders—Custom Clear Overlay Vinyl Binders, Dec. 19, 2012, 2 pages.—located in parent case.

* cited by examiner

BINDER

FIELD

The following description relates generally to binders.

BACKGROUND

Binders are typically used to hold items (e.g., paper, cardstock, photographs, binder accessories, etc.) within the binder. Items can be held within the binder by a ring mechanism or within pockets in the binder.

A binder typically includes a front cover and a back cover held together with a spine. Portions of the binder can be made to be relatively stiff or they can be made to be relatively flexible. The binder can include a flexible hinge between the front cover and the spine and another flexible hinge between the back cover and the spine to allow the binder to open and close. Due to strain placed on the hinges when the binder is opened or closed unevenly, the hinges are often the first component of the binder to wear out.

SUMMARY

According to embodiments of the present invention, a binder includes: a front cover including a front cover exterior layer, a front cover interior layer, a front cover base plate between the front cover exterior layer and the front cover interior layer, an exterior pocket formed between the front cover exterior layer and the front cover base plate, and an interior opening to the exterior pocket formed through the front cover interior layer and the front cover base plate.

In some embodiments, the exterior pocket is configured to contain an item so that the item is at least partially visible through the front cover exterior layer.

In some embodiments, the binder further includes a back cover and a spine coupled between the front cover and the back cover, and the back cover includes a back cover exterior layer, the spine includes a spine exterior layer, and each of the front cover exterior layer, the back cover exterior layer and the spine exterior layer include a polymer layer. The polymer layer can include easy processing polyethylene (EPPE) or blends thereof. In some embodiments the binder further includes a first hinge coupled between the front cover and the spine. In additional embodiments, the binder further includes a second hinge coupled between the back cover and the spine.

At least a portion of each of the front cover exterior layer and/or the spine exterior layer can be transparent.

In some embodiments, the spine further includes a spine interior layer, a spine panel between the spine exterior layer and the spine interior layer, a spine pocket between the spine panel and the spine interior layer, and a spine interior opening to the spine pocket through the spine interior layer.

The spine pocket can be configured to contain an item so that the item is at least partially visible through the spine exterior layer.

In some embodiments, the binder further includes a first hinge coupled between the front cover and the spine having an interior surface. The binder further includes a second hinge coupled between the back cover and the spine having an interior surface, and the front cover interior layer, the interior surface of the first hinge, the spine interior layer, the interior surface of the second hinge, and the back cover interior layer are formed from a single continuous layer. The single continuous layer can be a polymer layer. For example, the polymer layer can include easy processing polyethylene (EPPE) or blends thereof.

The back cover can further include a back cover base plate, and each of the front cover base plate and the back cover base plate can include foamed polypropylene.

In some embodiments, the front cover includes an edge, the interior opening formed through the front cover interior layer and the front cover base plate includes a central portion that is positioned substantially parallel to the edge of the front cover, and the interior opening through the front cover interior layer and the front cover base plate includes at least one end portion that curves away from the edge of the front cover.

A portion of the front cover base plate can be configured to be visible when the binder is in an open position. The front cover base plate can be a color that is different from that of the front cover interior layer.

The binder can further include a back cover including a back cover exterior layer; and a spine coupled between the back cover and the front cover, the spine including a spine exterior layer. The binder can further include a first hinge coupled between the front cover and the spine. The binder can further include a second hinge coupled between the back cover and the spine. In some embodiments, the first hinge includes a vertical ridge and at least two columns of ridges. The ridges of the at least two columns of ridges of the first hinge can be diagonal ridges. The second hinge can include a vertical ridge and at least two columns of ridges, and the ridges of the at least two columns of ridges of the second hinge can be diagonal ridges. In some embodiments, the ridges of the at least two columns of ridges of the first hinge are horizontal ridges. In some embodiments, the ridges of the two columns of ridges of the second hinge are horizontal ridges.

The first hinge and the second hinge can each include a plurality of valleys between the respective ridges of each column of ridges. In some embodiments, a ratio of a total area of the plurality of valleys of the first hinge to a total area of the first hinge is in a range of about 28% to about 32%, and a ratio of a total area of the plurality of valleys of the second hinge to a total area of the second hinge is in a range of about 28% to about 32%. For example, the ratio of the total area of the vertical ridge and the plurality of ridges of the first hinge to the total area of the plurality of valleys of the first hinge is about 30%, and the ratio of the total area of the vertical ridge and the plurality of ridges of the second hinge to the total area of the plurality of valleys of the second hinge is about 30%.

In some embodiments, the binder further comprises an interlayer between the front cover exterior layer and the front cover base plate. The front cover base plate can be bowed toward the front cover exterior layer.

According to another embodiment of the present invention, a binder includes: a front cover including a front cover exterior layer, a front cover interior layer, a front cover base plate between the front cover exterior layer and the front cover interior layer, a front cover interior pocket between the front cover interior layer and the front cover base plate, and a front cover interior opening to the front cover interior pocket formed through the front cover interior layer, the front cover interior opening being positioned diagonally with respect to an edge of the front cover; a back cover including a back cover exterior layer, a back cover interior layer, a back cover base plate between the back cover exterior layer and the back cover interior layer, the back cover interior layer and the front cover interior layer being configured to face each other when the binder is in a closed position, a back cover interior pocket between the back cover interior layer and the back cover base plate, and a back cover interior opening to the back cover interior pocket formed through the back cover interior layer, the back cover interior opening being positioned diagonally with respect to an edge of the back cover; and a spine between the front cover and the back cover.

In some embodiments, at least one of the front cover interior opening formed through the front cover interior layer and the back cover interior opening formed through the back cover interior layer has an s-shape.

In some embodiments, the opening through the front cover interior layer and the opening through the back cover interior layer are each positioned diagonally with respect to an edge of the front cover and an edge of the back cover, respectively.

A peripheral edge of the front cover interior opening through the front cover interior layer can be embossed such that at least a portion of the peripheral edge of the opening through the front cover interior layer bends away from the front cover base plate. A peripheral edge of the back cover interior opening through the back cover interior layer can be embossed such that at least a portion of the peripheral edge of the opening through the back cover interior layer bends away from the back cover base plate.

A portion of the front cover interior layer can be adhered to a portion of the front cover base plate with an adhesive, and a portion of the back cover interior layer can be adhered to a portion of the back cover base plate with an adhesive.

Another embodiment of the present invention is directed toward a method of manufacturing a binder, the method including: providing an interior polymer layer, an exterior polymer layer, and a foamed polymer layer. The method can further include cutting the interior polymer layer to form a single continuous interior layer including a front cover interior layer, a spine interior layer, a back cover interior layer; cutting the interior polymer layer to form an interior opening through the front cover interior layer, a front cover interior opening through the front cover interior layer, a spine interior opening through the spine interior layer, and a back cover interior opening through the back cover interior layer. The method can further include cutting the exterior polymer layer to form a single interconnected exterior layer including a front cover exterior layer, a spine exterior layer, and a back cover exterior layer. The method can further include cutting the foamed polymer layer to form a front cover base plate; cutting the foamed polymer layer to form an interior opening through the front cover base plate; and cutting a foamed polymer layer to form a back cover base plate. The method can further include stacking: the front cover base plate between the front cover interior layer and the front cover exterior layer; and the back cover base plate between the back cover interior layer and the back cover exterior layer; and sealing at least a portion of the single continuous interior layer and a portion of the single interconnected exterior layer together.

The step of sealing at least a portion of the single continuous layer and a portion of the single interconnected exterior layer together can include Radio Frequency (RF) welding, heat sealing, or ultrasonic welding. The step of sealing at least a portion of the single continuous layer and a portion of the single interconnected exterior layer together forms a seal area and a bumper bead. The seal area can have a width in a range of about 0.5 mm to about 1.5 mm and the bumper bead can have a width in a range of about 0.5 mm to about 1.5 mm.

In some embodiments, the interior opening formed through the front cover interior layer includes a peripheral edge, the front cover interior opening formed through the front cover interior layer includes a peripheral edge, the spine interior opening formed through the spine interior layer includes a peripheral edge, and the back cover interior opening formed through the back cover interior layer includes a peripheral edge, and the method further includes at least one of; a. embossing the peripheral edge of the interior opening through the front cover interior layer; b. embossing the peripheral edge of the front cover interior opening through the front cover interior layer; c. embossing the peripheral edge of the spine interior opening through the spine interior layer; and d. embossing the peripheral edge of the back cover interior opening through the back cover interior layer.

The method can further include: stacking a spine panel between the spine interior layer and the spine exterior layer; stacking a spacer between the spine interior layer and the spine panel; sealing at least a portion of the spine interior layer and a portion of the spine exterior layer together; and removing the spacer through a spine interior opening in the spine interior layer. The step of sealing the portion of the single continuous interior layer and the step of sealing the portion of the single interconnected exterior layer together and the sealing the portion of the spine interior layer and the portion of the spine exterior layer together can be performed concurrently.

BRIEF DESCRIPTION OF THE DRAWINGS

The accompanying drawings, together with the specification, illustrate exemplary embodiments of the present invention, and, together with the description, serve to explain the principles of the present invention. The drawings may not be to scale, and the relative proportions of the features shown in the drawings may vary between the drawings.

DETAILED DESCRIPTION

Figure 1:
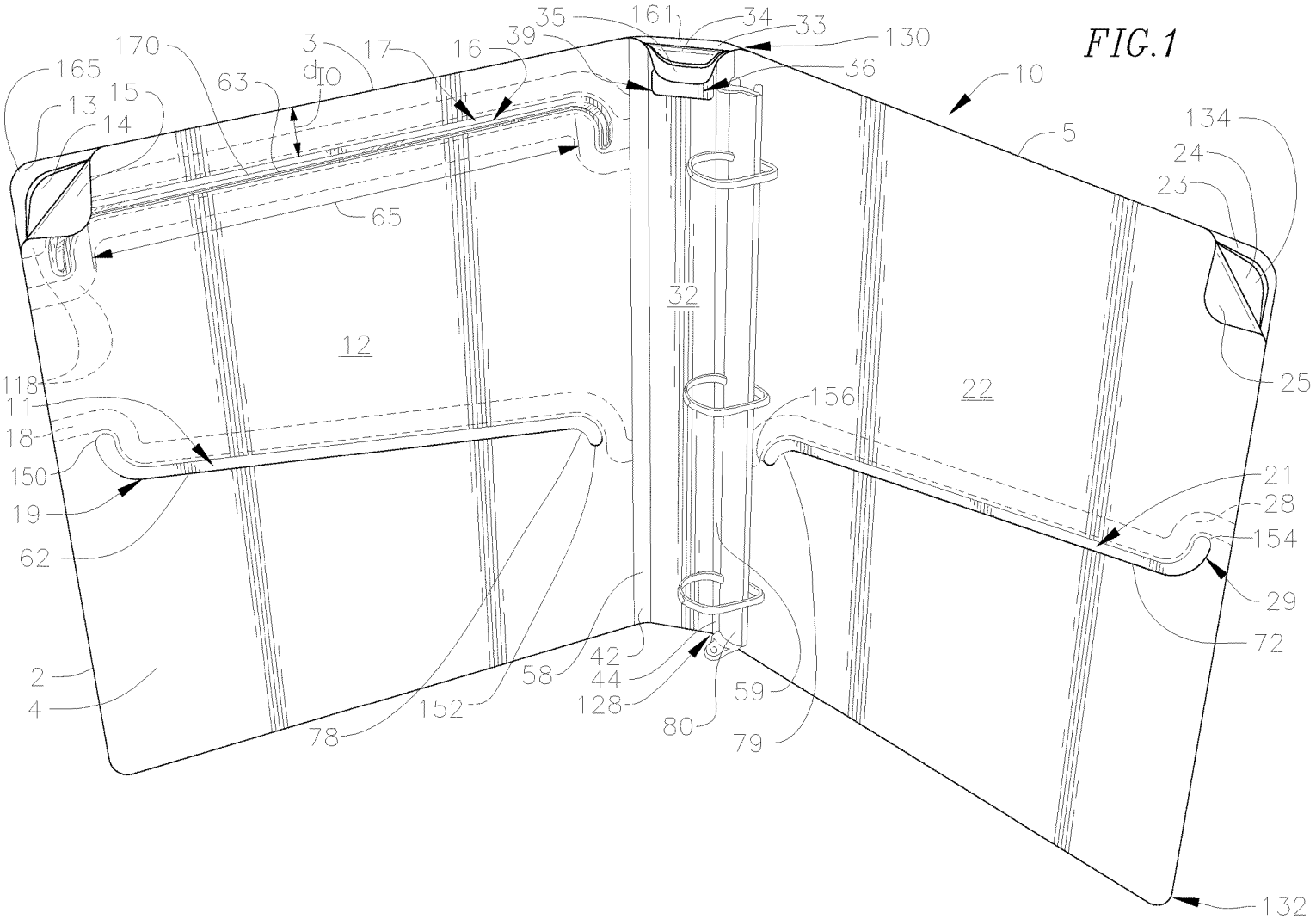
FIG. 1 is a perspective (partially peeled-away) view of the interior of a binder according to an embodiment of the invention.
Figure 2:
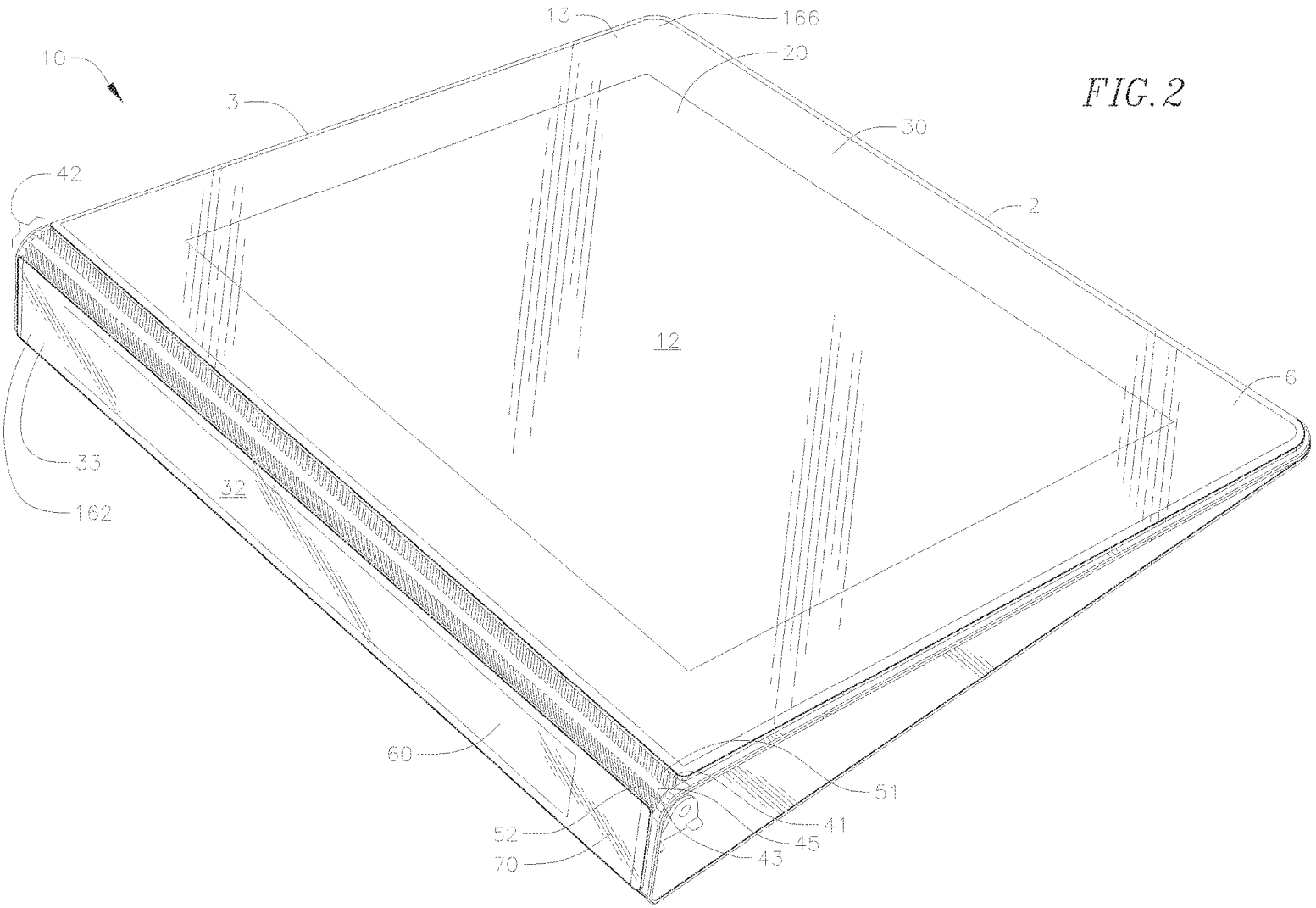
FIG. 2 is a perspective view of the binder of FIG. 1 in a closed position.

In the following detailed description, only certain exemplary embodiments of the present invention are shown and described, by way of illustration. As those skilled in the art would recognize, the invention can be embodied in many different forms and should not be construed as being limited to the embodiments set forth herein. Also, in the context of the present application, when a first element is referred to as being "on" a second element, it can be directly on the second element or be indirectly on the second element with one or more intervening elements interposed therebetween. Like reference numerals designate like elements throughout the specification.

Binders are typically used to hold items (e.g., paper, cardstock, photographs, binder accessories, etc.) within the binder by a ring mechanism or within pockets in the binder. A binder can have a front cover and a back cover, the covers having sizes suitable for holding standard sizes of paper, such as paper having dimensions of 8.5 inches (216 mm) by 11 inches (279 mm). Binders also come in other formats suitable for holding other sizes of paper, such as paper having dimensions of 5.5 inches (140 mm) by 8.5 inches (216 mm) or A4 paper (e.g., a sheet having dimensions of 8.27 inches (210. mm) by 11.69 inches (296. mm). A binder can also include a spine between the front and back covers, the spine having a size suitable for accommodating a mechanism for retaining items such as paper. For example, the spine can have a size suitable for accommodating a ring mechanism. Typically, ring mechanisms have rings having a diameter of 0.5 inch (12.7 mm), 1 inch (25.4 mm), 1.5 inches (38.1 mm), 2 inches (50.8 mm), 3 inches (76.2 mm), 4 inches (102 mm), or 5 inches (127 mm). The ring mechanism can include 2, 3, 4, 5, or 6 rings. The present invention is not limited by the size of the binder, the size or type of the ring mechanism, or the number of rings of the ring mechanism.

FIG. 1 is a front, top perspective view (partially peeled-away) of the interior of a binder 10 according to embodiments of the present invention. In FIG. 1, the binder 10 includes a front cover 12, a back cover 22 and a spine 32 between the front cover 12 and the back cover 22. The binder 10 in FIG. 1 is shown in a partially open position. The spine 32 is hingeably coupled to the front cover 12 through a first hinge 42, and the spine 32 is hingeably coupled to the back cover 22 through a second hinge 44. Accordingly, the binder 10 can hingeably move from a fully open position to a fully closed position. In FIGS. 2-8, the binder 10 is shown in a fully closed position. The binder 10 is shown in a fully open position in FIGS. 9, 10 and 12-16. Although the binder 10 can be further opened from the position shown in FIGS. 9, 10 and 12-16, since this is the position that the binder 10 would be in when laid open on a flat surface, this position is referred to as the "fully open" position.

As shown in FIG. 1, in embodiments of the invention, the front cover 12 includes a front cover exterior layer 13, a front cover interior layer 15, and a front cover base plate 14 between the front cover exterior layer 13 and the front cover interior layer 15. Similarly, the back cover 22 can include a back cover exterior layer 23, a back cover interior layer 25, and a back cover base plate 24 between the back cover exterior layer 23 and the back cover interior layer 25, and the back cover interior layer 25 and the front cover interior layer 15 can be configured to face each other when the binder is in a closed position. The spine 32 can include a spine exterior layer 33, a spine interior layer 35, and a spine panel 34 between the spine exterior layer 33 and the spine interior layer 35. The binder can also include any suitable mechanism for retaining items, such as the ring mechanism 80 shown in FIG. 1

In some embodiments, the front cover interior layer 15, back cover interior layer 25, spine interior layer 35 and interior surfaces 58 and 59 of the hinges 42 and 44, respectively, all form a single layer (e.g., an interior layer 4 of the binder 10) formed from a single, continuous sheet of material, which can also include openings (or cutouts) as described below in more detail. For example, the front cover interior layer 15, back cover interior layer 25, spine interior layer 35 and inner surfaces 58 and 59 of the hinges 42 and 44, respectively, can all be formed from a single layer (e.g., the interior layer 4) of any suitable polymer and polymer blends, such as, for example, easy processing polyethylene (EPPE), a blend thereof (e.g., a blend of EPPE and ethylene vinyl acetate), or any other material that can be Radio Frequency (RF), heat seal, or ultrasonically welded, such as polypropylene or polyvinyl chloride, but the present invention is not limited thereto. EPPE can be obtained from Sumitomo Chemical Asia, PTE Ltd. located in the Republic of Singapore. EPPE is a polyethylene polymer having long chain branching that is manufactured using a metallocene catalyst, and exhibits processability characteristics similar to those of high pressure low density polyethylene (HP-LDPE), but has considerably higher mechanical strength. A suitable EPPE film can be obtained from, for example, Dongguan Kai Yuan Plastication Technology Co., Ltd. located in Guangdong, People's Republic of China. The front cover interior layer 15, back cover interior layer 25, and spine interior layer 35 can each independently have a thickness $t_{IL}$ (shown in FIGS. 19, 23, 24, 26, 27, 29, 30, 32A, 37, and 38, which are described in more detail below) in a range of about 0.3 mm to about 0.8 mm, for example 0.5 mm. The interior surfaces 58 and 59 of the hinges 42 and 44, respectively, can each independently be formed from a polymer layer having the thickness $t_{IL}$ in a range of about 0.3 mm to about 0.8 mm, for example 0.5 mm. Portions of the interior layer 4 of the binder 10, such as the front cover interior layer 15, back cover interior layer 25 and spine interior layer 35 can be textured (e.g., embossed) to provide the binder 10 with increased stability and an aesthetically pleasing look and feel. In other embodiments, the front cover interior layer 15, back cover interior layer 25, and spine interior layer 35 are left smooth (e.g., not textured). Any or all of the front cover interior layer 15, back cover interior layer 25, and spine interior layer 35 can be textured or smooth. The interior layer 4 of the binder can be colored. For example, each of the front cover interior layer 15, back cover interior layer 25, spine interior layer 35, and respective interior surfaces 58 and 59 of the hinges 42 and 44 can be any color, for example, gray, red, white, black, blue, green, yellow, or any other color or combination of colors.

Figure 16:
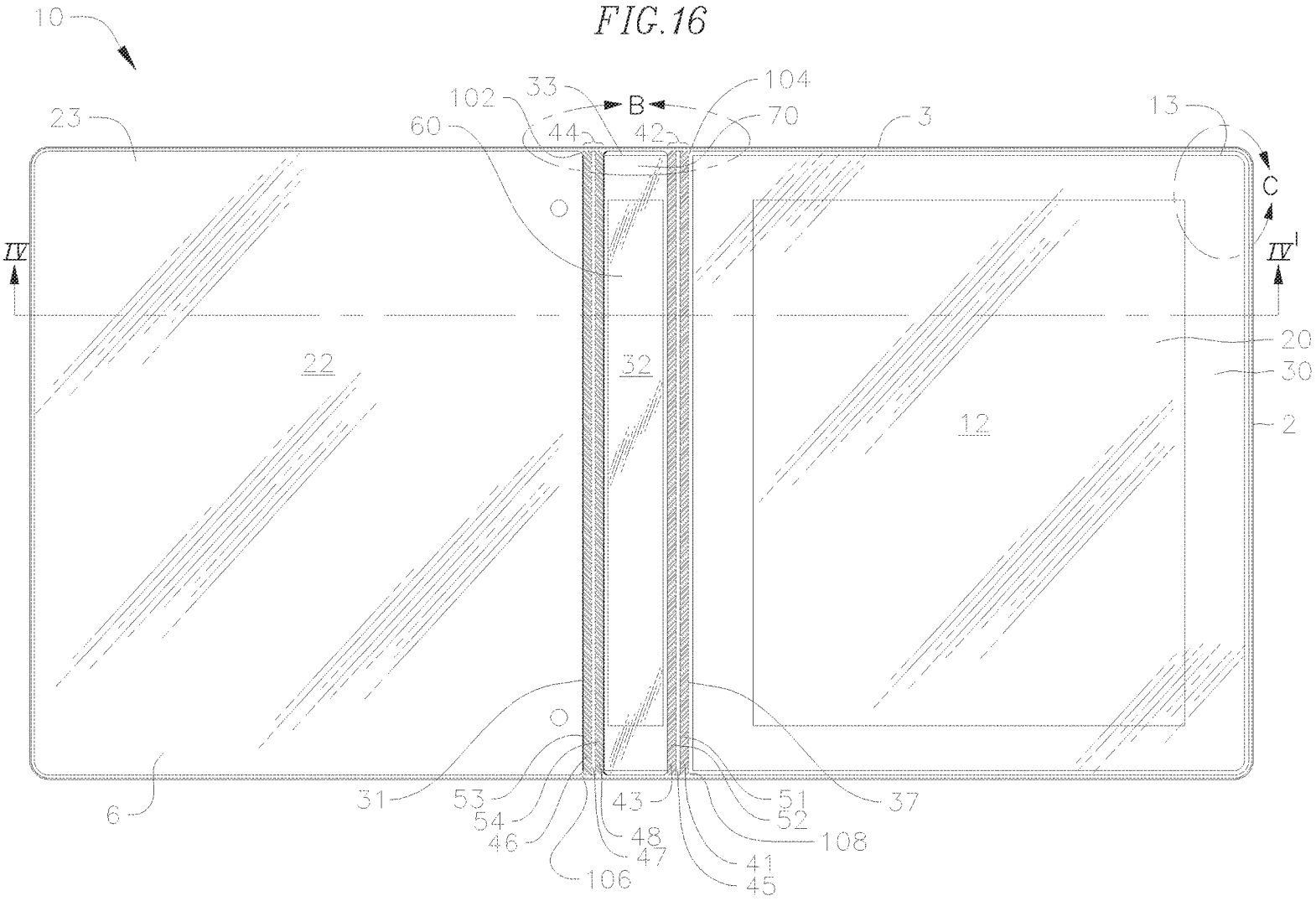
FIG. 16 is a back plan view of the exterior of the binder of FIG. 9.

FIG. 16 is a back plan view of the binder 10 according to embodiments of the invention, shown in the fully open position. As shown in FIG. 16, the first hinge 42 can include a vertical ridge 45 and the second hinge 44 can include a vertical ridge 47. The vertical ridge 45 and the front cover exterior layer 13 are part of an exterior layer 6, which can further include a plurality of diagonal ridges 41 having valleys 51 therebetween, and diagonal ridges 43 having valleys 52 therebetween. As used herein throughout this document, the term "plurality" refers to two or more. The valleys are sealed portions of the hinge. As used herein, the term "sealed" refers to two or more layers that have been permanently bonded together, for example through melting (e.g., by RF, heat seal, or ultrasonic welding). The exterior layer 6 can further include the spine exterior layer 33, the vertical ridge 47, a plurality of diagonal ridges 46 having valleys 53 therebetween, and a plurality of diagonal ridges 48 having valleys 54 therebetween. For example, the front cover exterior layer 13, diagonal ridges 41 and 43, valleys 51 and 52, vertical ridge 45, spine exterior layer 33, diagonal ridges 46 and 48, valleys 53 and 54, vertical ridge 47, and back cover exterior layer 23 can all form a single layer (e.g., the exterior layer 6) formed from a single interconnected sheet of material. The front cover exterior layer 13, diagonal ridges 41 and 43, valleys 51 and 52, vertical ridge 45, spine exterior layer 33, diagonal ridges 46 and 48, valleys 53 and 54, vertical ridge 47, and back cover exterior layer 23 can all be formed from a single layer (e.g., the exterior layer 6) of any suitable polymer and polymer blends, for example, EPPE, a blend thereof (e.g., a blend of EPPE and ethylene vinyl acetate), or any other material that can be RF, heat seal, or ultrasonically welded, such as polypropylene or polyvinyl chloride, but the present invention is not limited thereto. EPPE can be obtained from Sumitomo Chemical Asia, PTE Ltd. located in the Republic of Singapore, or EPPE film can be obtained, for example, from Dongguan Kai Yuan Plastication Technology Co., Ltd. located in Guangdong, People's Republic of China. The front cover exterior layer 13, spine exterior layer 33, and back cover exterior layer 23 can each have a thickness $t_{EL}$ (shown in FIGS. 19, 23, 24, 26, 27, 29, 30, 32A, 37, and 38, which are described in more detail below) in a range of about 0.3 mm to about 0.8 mm, for example about 0.5 mm. The diagonal ridges 41 and 43, valleys 51 and 52, vertical ridge 45, diagonal ridges 46 and 48, valleys 53 and 54, and vertical ridge 47 can each independently be formed from a polymer layer having the thickness $t_{EL}$ in a range of about 0.3 mm to about 0.8 mm, for example 0.5 mm. The exterior layer 6 can be translucent, transparent, or colored. In some embodiments, at least a portion of the exterior layer 6 is translucent or transparent, while other portions of the exterior layer 6 are colored. For example, the diagonal ridges 41 and 43, valleys 51 and 52, vertical ridge 45, diagonal ridges 46 and 48, valleys 53 and 54, vertical ridge 47 and back cover exterior layer 23 can be translucent or transparent, and at least a portion of the front cover exterior layer 13 and/or the spine exterior layer 33 can be translucent or transparent, while another portion of the front cover exterior layer 13 and/or the spine exterior layer 33 can be colored. The exterior layer 6 can be colored with any color, for example, gray, red, white, black, blue, green, yellow, or any other color or combination of colors.

Figure 17:
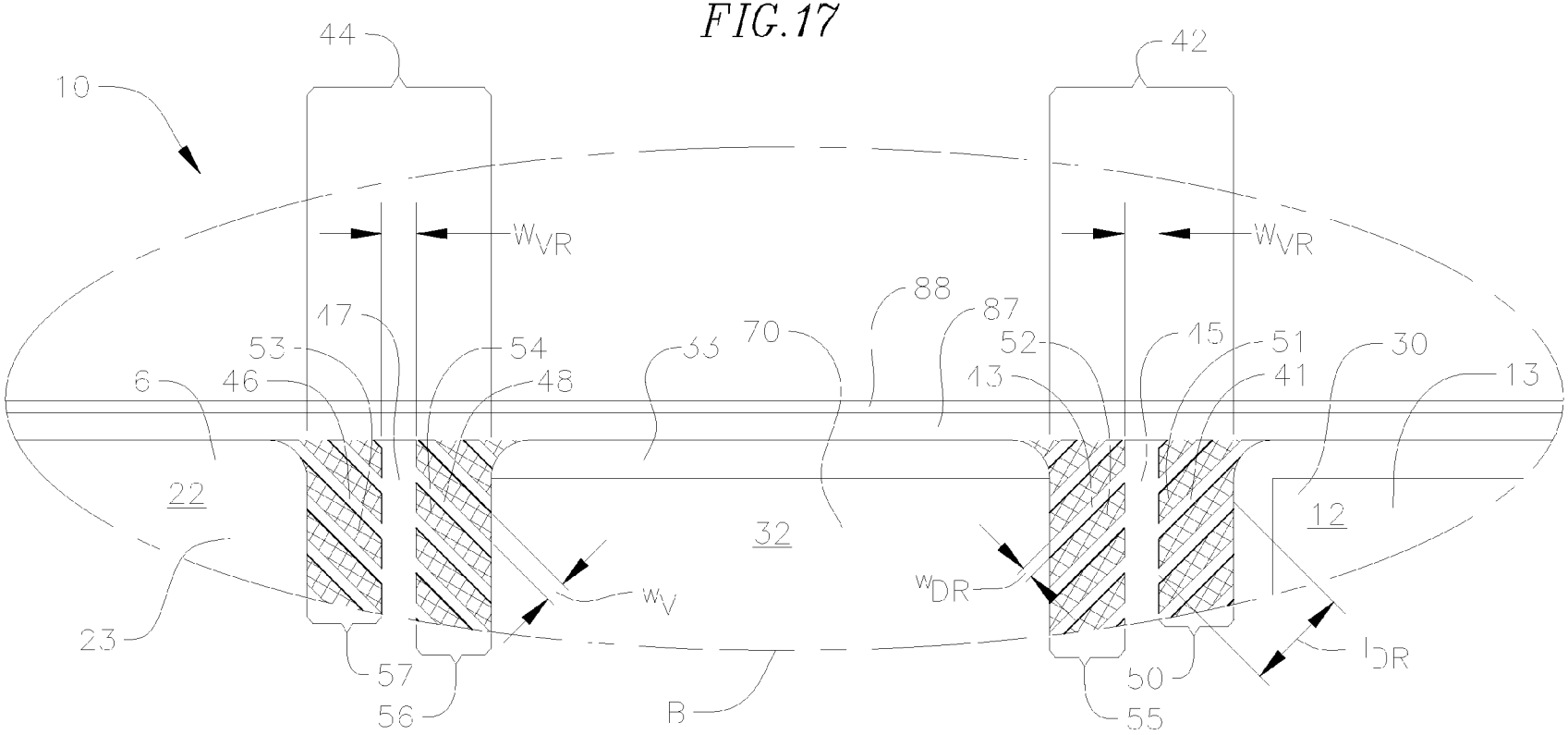
FIG. 17 is a partial close-up back view of the circled portion B of the top of the exterior of the binder of FIG. 16.

In FIG. 16, the vertical ridges 45 and 47 the diagonal ridges 41, 43, 46, and 48 and valleys 51, 52, 53, and 54 may not be to scale, for ease of illustration, and can be substantially smaller or larger, more numerous, and/or spaced closer together or farther apart as desired. FIG. 17 is a partial close-up view of a circled portion B of the binder 10 of FIG. 16 showing that the diagonal ridges 41, 43, 46, and 48 can be arranged diagonally (e.g., as ridges that diagonally extend away from the vertical ridge 45 or the vertical ridge 47), but the present invention is not limited thereto. As shown in FIG. 17, the diagonal ridges 41, 43, 46, and 48 can each have a width $w_{DR}$ in a range of about 0.5 mm to about 1.5 mm, for example about 1 mm. The diagonal ridges 41, 43, 46, and 48 can each have a length $l_{DR}$ in a range of about 2 mm to about 4 mm, for example about 3 mm. The vertical ridge 45 has a width $w_{VR}$ in a range of about 0.5 mm to about 3.0 mm, for example, about 2 mm. The vertical ridge 47 has a width $w_{VR}$ in a range of about 0.5 mm to about 3.0 mm, for example, about 2.0 mm. In FIG. 17, the valleys 51, 52, 53 and 54 are shown as cross-hatched areas and each have a width $w_V$ in a range of about 1 mm to about 2 mm, for example, about 1 mm or 1.5 mm. The valleys 51, 52, 53, and 54 are shown as cross-hatched areas to show the area of the valleys. Although other features of the binder, such as a seal area 87, can be at the same level as the valleys 51, 52, 53, and 54, the other features of the binder are not cross-hatched for clarity. As shown in FIG. 17, the first hinge 42 also includes a portion of the seal area 87 and a bumper bead 88, which are formed by permanently bonding the interior layer 4 and the exterior layer 6 together through, for example, by melting (e.g., by RF, heat seal, or ultrasonic welding).

The above-described hinges 42 and 44 are formed by welding (e.g., radio frequency welding) along columns 50, 55, 56, and 57, which results in the formation of the vertical ridges 45 and 47, diagonal ridges 41, 43, 46, and 48, and valleys 51, 52, 53, and 54. The welding results in each hinge having at least three hinge axes (e.g., axes along which the hinge can bend). For example, the first hinge 42 can bend along the columns 50 and 55. The hinge 42 can also bend along the vertical ridge 45. Thus, the hinge 42 can bend along the vertical ridge 45 and the columns 50 and 55 (e.g., the hinge 42 has at least three axes along which the hinge 42 can bend). The second hinge 44 can be arranged in a manner similar to the above-described arrangement of the first hinge 42.

As a result of having three (or more) hinge axes, the hinges 42 and 44 have improved durability. In a typical binder, the first component to wear out is often a hinge. Users frequently open or close a binder unevenly, which exerts a twisting motion and, therefore, torque, on the binder hinge. The twisting motion places stress on the top and bottom of the hinge causing accelerated wear and often leading to failure of the hinge. A hinge having three hinge axes according to embodiments of the present invention is more durable than a hinge having only one, or even two, hinge axes as the stress on any one hinge axis in the present embodiments can be reduced because the stress is distributed across more than one hinge axis. By reducing the amount of stress placed on the hinge axes, a hinge according to embodiments of the invention reduces the rate at which the hinge wears, thereby improving hinge durability and longevity.

In addition to having improved durability and longevity, hinges 42 and 44 according to embodiments of the present invention also have suitable flexibility and resiliency. For example, the above-described vertical ridges 45 and 47, diagonal ridges 41, 43, 46, and 48, and valleys 51, 52, 53, and 54 can be arranged relative to one another on the binder 10 to provide hinges 42 and 44 having suitable flexibility and resiliency. A ratio of a total area of the valleys 51 and 52 between the diagonal ridges 41 and 43 to a total area of the first hinge 42 may affect the flexibility and resiliency of the first hinge 42. The area of some of the valleys 51, 52, 53, and 54 is shown in FIG. 17 as the cross-hatched regions. If the valleys 51, 52, 53 and 54 are eliminated so that the total area of the valleys is zero (e.g., the entire surface of the first hinge 42 is welded such that the first hinge 42 has an uninterrupted and flat surface), then the resiliency of the first hinge 42 may be too high and a binder including such a hinge may spring open when placed vertically on a surface in the closed position.

According to some embodiments of the invention, when the ratio of the total area of the valleys 51 and 52 between the diagonal ridges 41 and 43 to the total area of the first hinge 42 is in a range of about 28% to about 32%, such as, for example, a ratio of about 30%, the first hinge 42 will have suitable flexibility and resiliency. The vertical ridge 47, the diagonal ridges 46 and 48, and corresponding valleys 53 and 54 of the second hinge 44 behave in a manner similar to that described above with respect to the first hinge 42. Accordingly, in some embodiments of the invention, when the ratio of the total area of the valleys between the diagonal ridges 46 and 48 to the total area of the first hinge 42 is in a range of about 28% to about 32%, such as, for example, a ratio of about 30%, the second hinge 44 will have suitable flexibility and resiliency.

Figure 18:
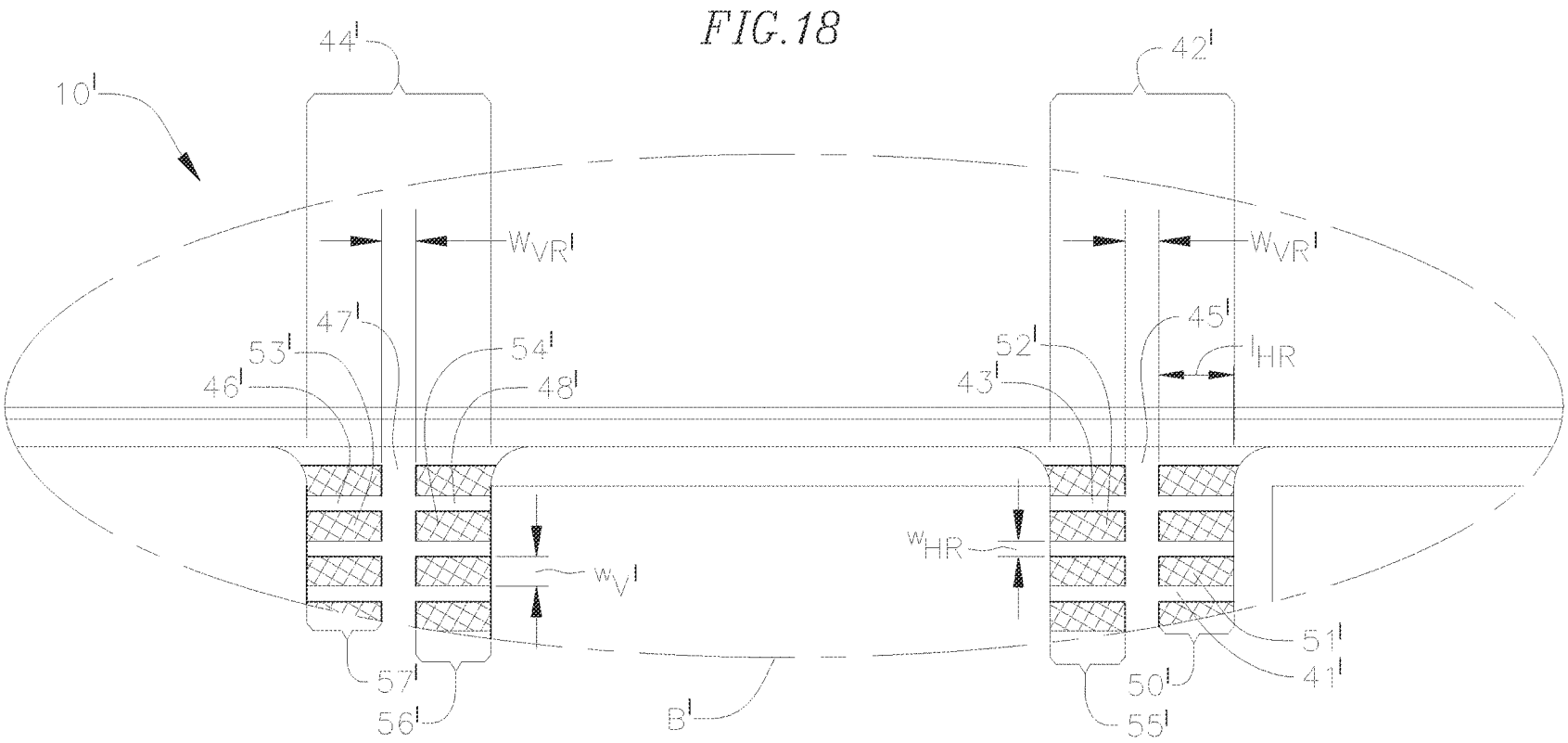
FIG. 18 is a partial close-up back view B' showing an alternative embodiment of the circled portion B of the binder of FIG. 16.

As shown in FIGS. 16 and 17, the first hinge 42 includes the columns 50 and 55, each of which include ridges, and the second hinge 44 includes the columns 56 and 57, each of which include ridges. For example, in FIGS. 16 and 17, the columns 50, 55, 56, and 57 include the diagonal ridges 41, 43, 48, and 46, respectively. In another embodiment, a binder 10', which is shown in FIG. 18, includes columns 50', 55', 56', and 57', each of which include ridges. In FIG. 18, circled portion B' is a different embodiment of the circled portion B of FIG. 16. For example, in FIG. 18, the columns 50', 55', 56', and 57' include horizontal ridges 41', 43', 48', and 46', respectively, that extend away from a vertical ridge 45' or a vertical ridge 47' horizontally (e.g., at an angle of about 90° with respect to the vertical ridge 45' or the vertical ridge 47'). The horizontal ridges each have a width $w_{HR}$ in a range of about 0.5 mm to about 1.5 mm, for example about 1 mm. As shown in FIG. 18, in a first hinge 42' the horizontal ridges 41' have valleys 51' therebetween and the horizontal ridges 43' have valleys 52' therebetween. Similarly, in a second hinge 44' the horizontal ridges 48' have valleys 54' therebetween and the horizontal ridges 46' have valleys 53' therebetween. In FIG. 18, the valleys are shown as cross-hatched areas and each have a width $w_{V'}$ in a range of about 1 mm to about 2 mm, for example, about 1 mm or 1.5 mm. The horizontal ridges 51', 52', 53', and 54' each have a length $l_{HR}$ in a range of 2 mm to about 4 mm, for example, about 3 mm. In the embodiment shown in FIG. 18, the vertical ridge 45' has a width $w_{VW'}$ in a range of about 0.5 mm to about 3.0 mm, for example, about 2.0 mm. The vertical ridge 47' has a width $w_{VR'}$ in a range of about 0.5 mm to about 3.0 mm, for example, about 2.0 mm.

The characteristics of the hinges 42' and 44' are similar to those described above with respect to the hinges 42 and 44. For example, the first hinge 42' can bend along the vertical ridge 45' and columns 50' and 55', and the second hinge 44' can bend along the vertical ridge 47' and columns 56' and 57'. Additionally, when the total area of the valleys 51' and 52' between the horizontal ridges 41' and 43' to the total area of the first hinge 42' is in a range of about 28% to about 32%, such as, for example, a ratio of about 30%, the first hinge 42' will have suitable flexibility and resiliency. The vertical ridge 47', the horizontal ridges 46' and 48', and corresponding valleys 53' and 54' of the second hinge 44' behave in a manner similar to that described above with respect to the first hinge 42'. The area of some of the valleys 51', 52', 53' and 54' is shown in FIG. 18 as the cross-hatched regions.

In any of the embodiments, the diagonal ridges or the horizontal ridges can be co-linear with the other diagonal ridges or horizontal ridges, respectively, or they can form any suitable angle between 0 and 180° with one another. For example, the diagonal ridges 41 can be co-linear with the diagonal ridges 43 (as shown in FIG. 17), or they can form any suitable angle between 0 and 180° with one another. The diagonal ridges 46 and 48 can be arranged in a manner similar to that of the diagonal ridges 41 and 43. The diagonal ridges 41, 43, 46, and 48 can be placed in any arrangement. Similarly, the horizontal ridges 41' can be co-linear with the horizontal ridges 43' (as shown in FIG. 18), or they can form any suitable angle between 0 and 180° with one another. The horizontal ridges 46' and 48' can be arranged in a manner similar to that of the horizontal ridges 41' and 43'. The horizontal ridges 41', 43', 46', and 48' can be placed in any arrangement.

Referring back to FIGS. 16 and 17, in some embodiments of the invention, the front cover exterior layer 13, back cover exterior layer 23, spine exterior layer 33, vertical ridges 45 and 47, and diagonal ridges, 41, 43, 46, and 48 all form a single layer (e.g., the exterior layer 6) formed from a single, interconnected sheet of material, which also includes the above-described valleys 51, 52, 53, and 54 in the layer. For example, the front cover exterior layer 13, back cover exterior layer 23, spine exterior layer 33, vertical ridges 45 and 47, and diagonal ridges, 41, 43, 46, and 48 can all be formed from a single interconnected layer of any suitable polymer, such as, for example, EPPE or a blend thereof (e.g., a blend of EPPE and ethylene vinyl acetate), or any other material that can be RF, heat seal, or ultrasonically welded, such as polypropylene or polyvinyl chloride, but the present invention is not limited thereto. The single interconnected layer of the polymer can be transparent or translucent. The front cover exterior layer 13, back cover exterior layer 23, and spine exterior layer 33 can each independently have a thickness $t_{EL}$ (shown in FIGS. 19, 23, 24, 26, 27, 29, 30, 32A, 37, and 38, which are described in more detail below) of about 0.5 mm.

According to the embodiments described above, the first hinge 42 (and first hinge 42') and the second hinge 44 (and second hinge 44') each include a portion of the interior layer 4 and a portion of the exterior layer 6. As such, the hinges 42 and 44 made be referred to as "living hinges" (e.g., a thin flexible hinge made from the same material as the pieces connected by the hinge). As the hinges 42 and 44 each include a portion of the interior layer 4 and the exterior layer 6, the hinges 42 and 44 include the same materials as the interior layer 4 and exterior layer 6. In some embodiments, each of the interior layer 4 and the exterior layer 6 is a polymer, such as EPPE or blends thereof, or any other material that can be RF, heat seal, or ultrasonically welded, such as polypropylene or polyvinyl chloride, but the present invention is not limited thereto. As such, the hinges 42 and 44 can each include a polymer, such as EPPE. Further, in some embodiments, each of the first hinge 42 and second hinge 44 includes a blend of EPPE, such as a blend of EPPE and ethylene vinyl acetate.

Figure 3:
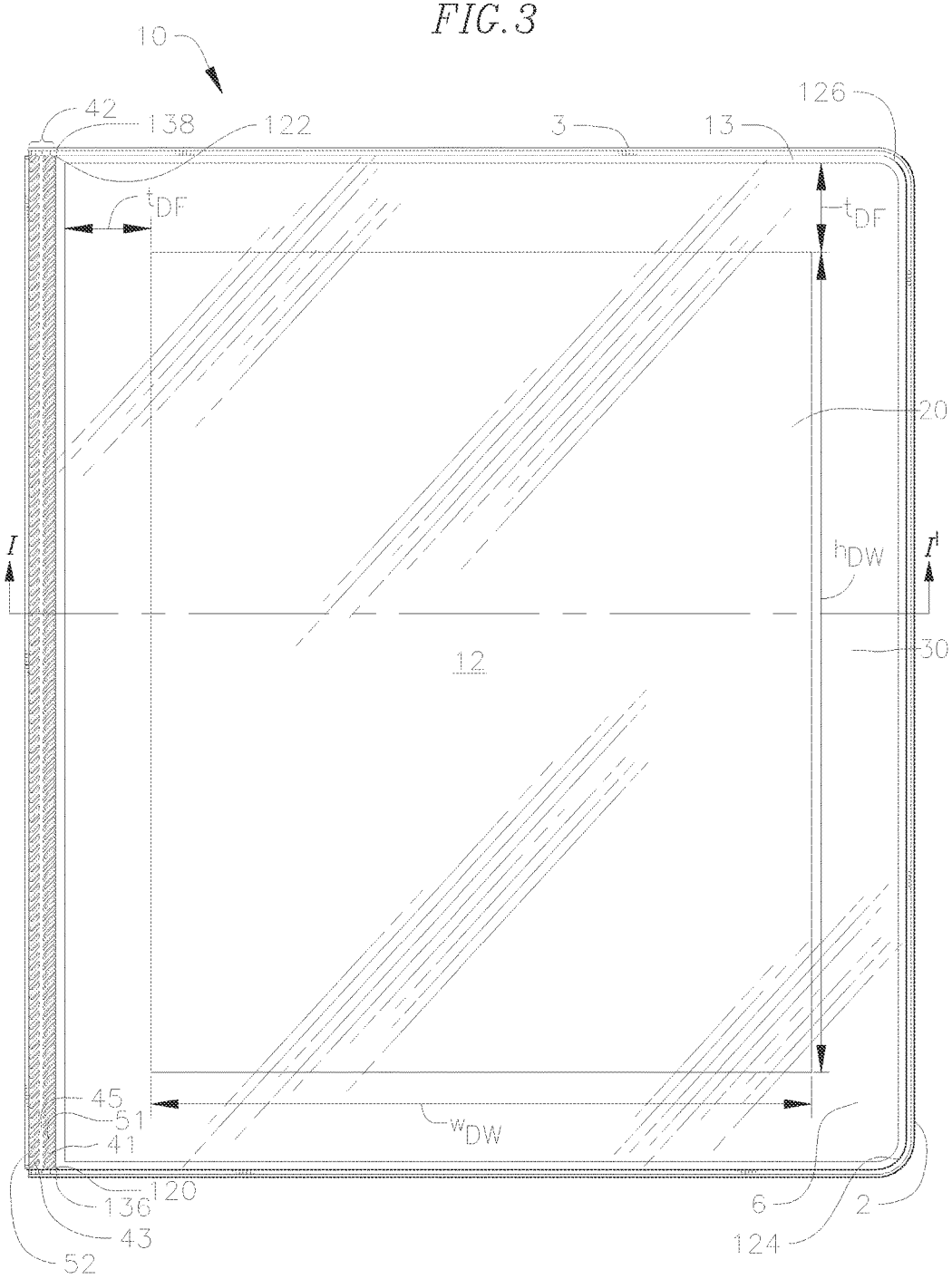
FIG. 3 is a front plan view of the binder of FIG. 1 in a closed position.
Figure 4:
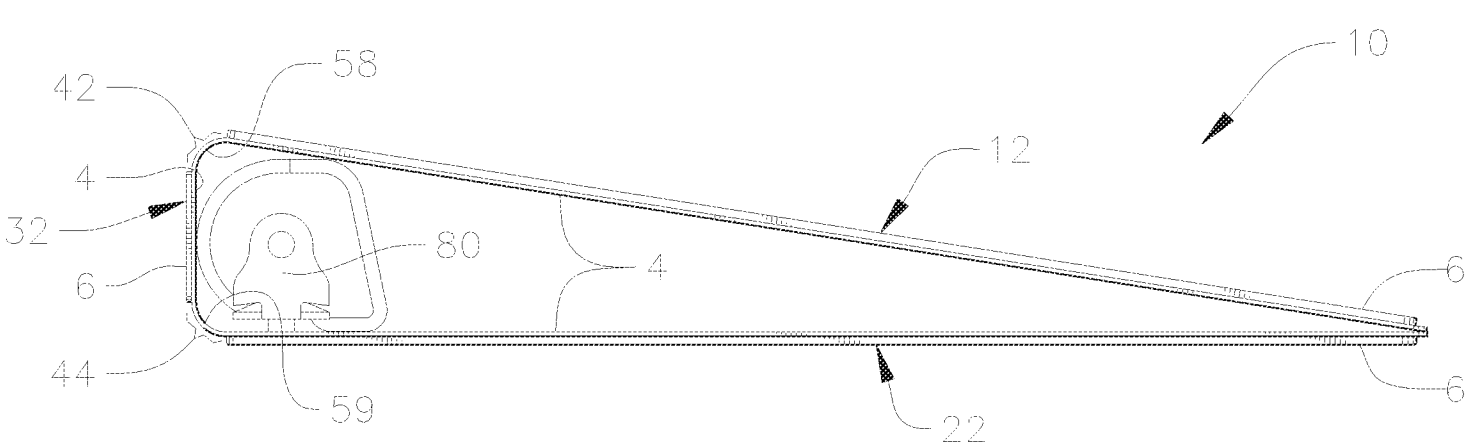
FIG. 4 is a bottom elevational view of the binder of FIG. 1 in a closed position.
Figure 19:
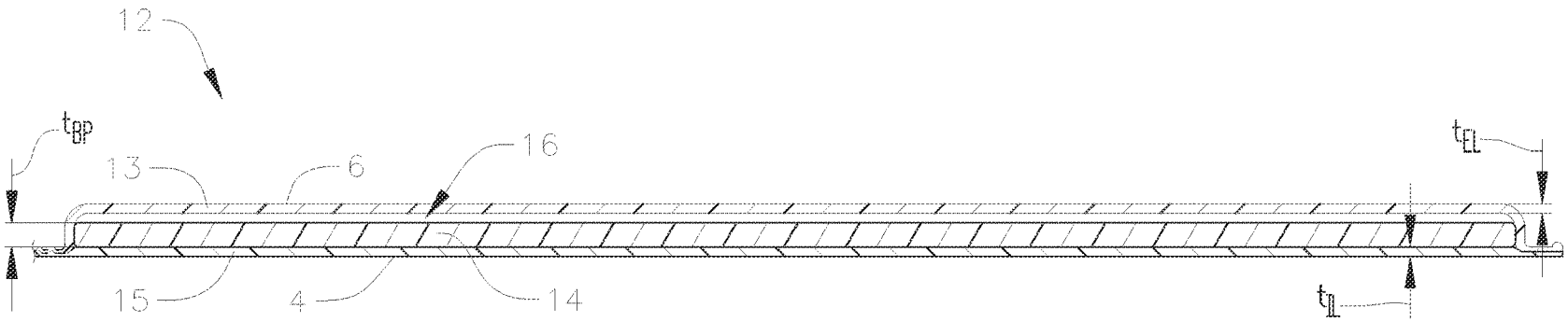
FIG. 19 is a fragmentary cross-sectional view of the front cover of the binder of FIG. 3 cut along the line I-I'.

As shown in the cross-sectional view in FIG. 19 (and in FIG. 1) of the front cover 12 of FIG. 3 cut along the line I-I', in some embodiments, the front cover 12 includes an exterior pocket 16. The exterior pocket 16 can be between the front cover exterior layer 13 and the front cover base plate 14. The front cover 12 can also include an interior opening 17 (shown in FIG. 1 having a bottom edge 63) through the front cover interior layer 15 and the front cover base plate 14 to the exterior pocket 16. The interior opening 17 can be located a distance from an edge of the binder 10, for example an edge 2 or an edge 3 (shown in FIG. 1). For example, as shown in FIG. 1, the interior opening 17 is shown a distance $d_{IO}$ from the edge 3. The distance $d_{IO}$ can be in a range of about 10 mm to about 30 mm, for example 20 mm. The interior opening 17 can have a central portion 65 positioned substantially parallel to the edge 3. In another embodiment, the central portion 65 of the interior opening 17 is positioned substantially parallel to the edge 2. For example, the central portion 65 of the interior opening 17 can be positioned substantially horizontally with respect to the binder 10, or it can be positioned substantially vertically with respect to the binder 10. Items placed in an exterior pocket having exterior openings can fall out of the pocket. According to embodiments of the invention, however, the interior opening 17 passes through the front cover base plate 14 (e.g., at least a portion of the interior opening 17 is formed by the front cover base plate 14) to the exterior pocket 16, and items placed in the exterior pocket 16 will be retained within the exterior pocket 16 by the front cover base plate 14.

Figure 10:
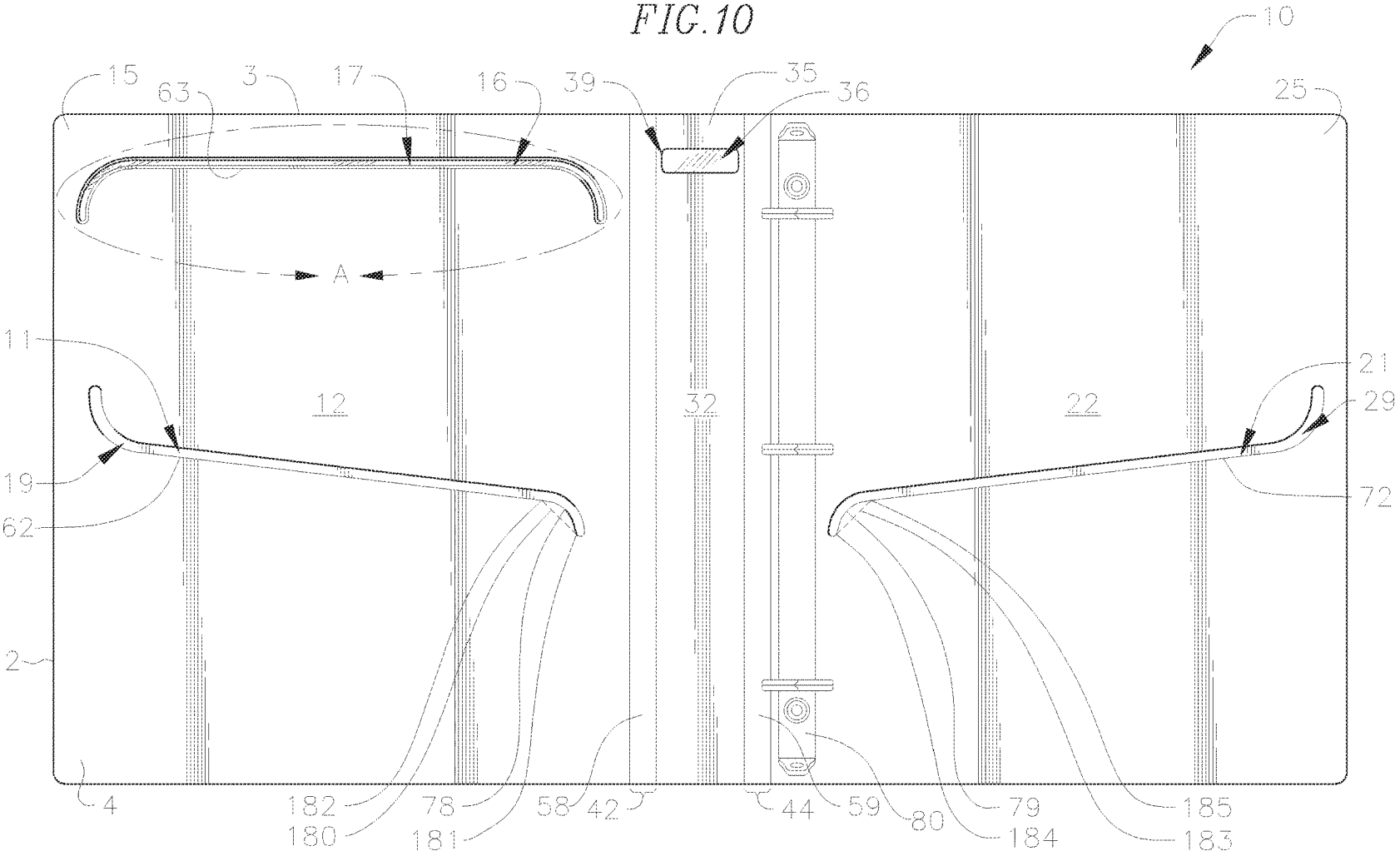
FIG. 10 is a front plan view of the binder of FIG. 9.
Figure 11:
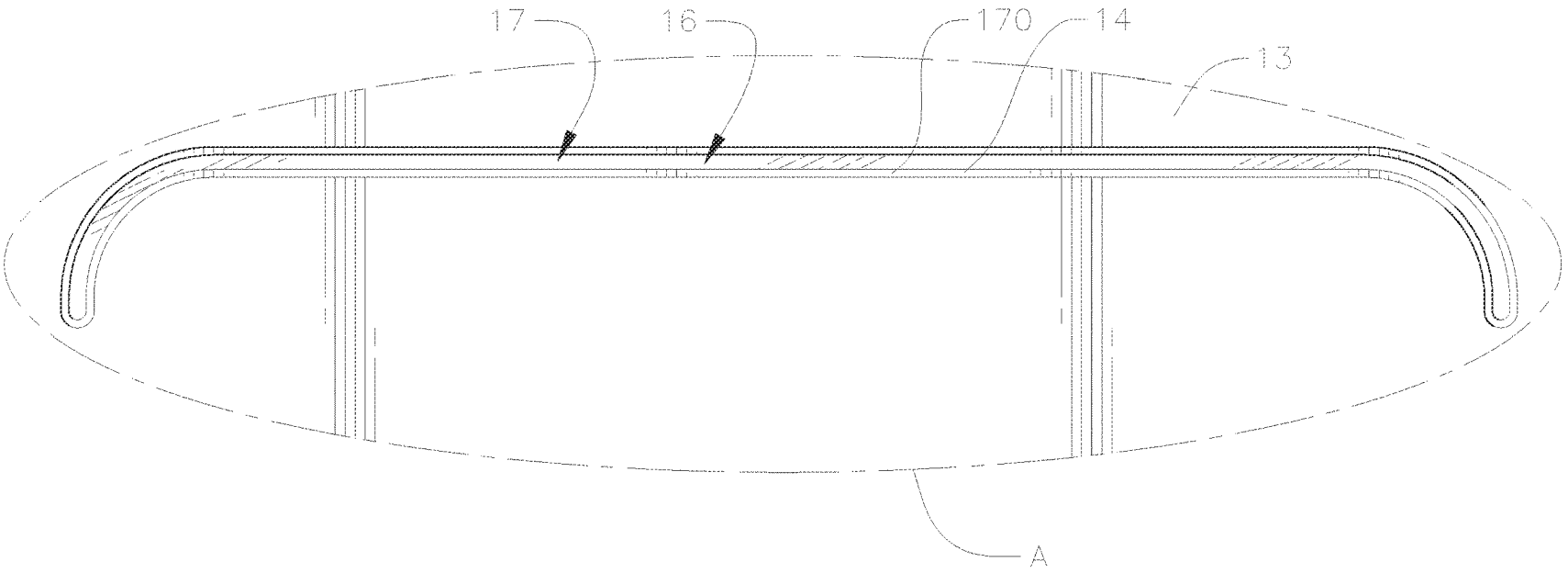
FIG. 11 is a partial close-up view of the circled portion A of the top of the interior of the binder of FIG. 10.
Figure 12:
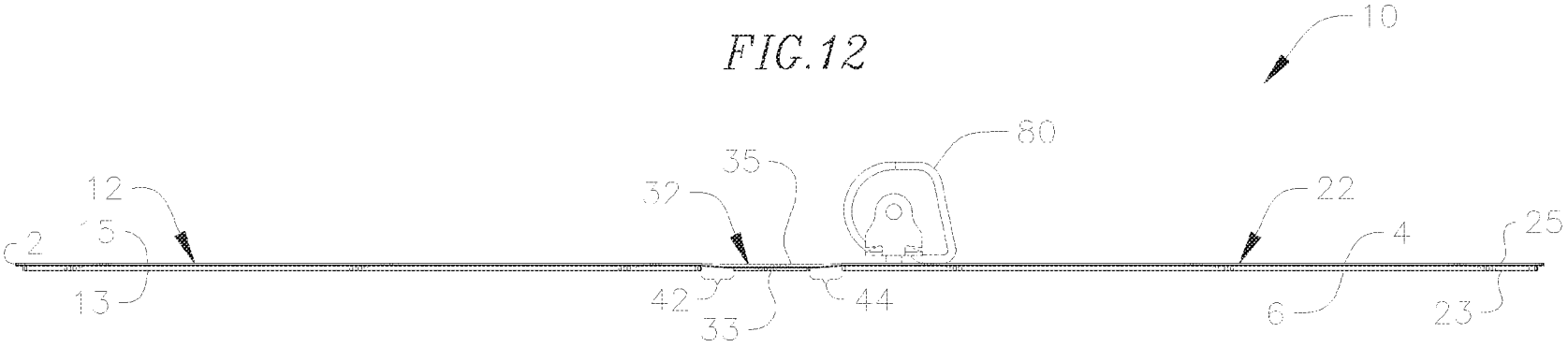
FIG. 12 is a bottom elevational view of the binder of FIG. 9.
Figure 13:
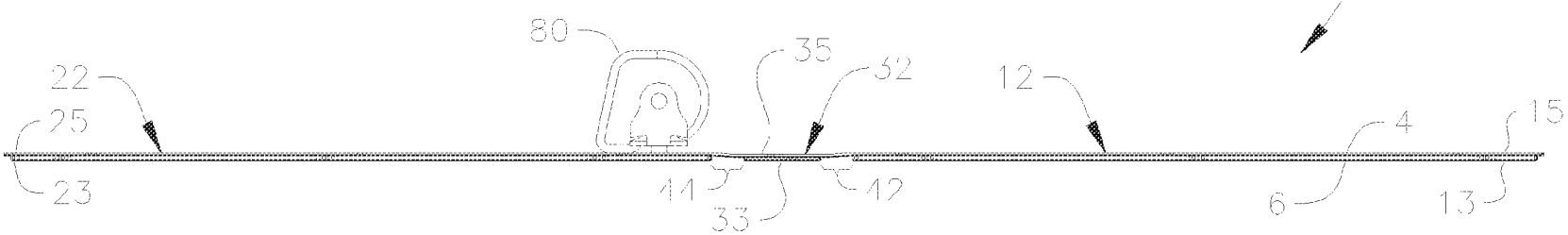
FIG. 13 is a top elevational view of the binder of FIG. 9.
Figure 14:
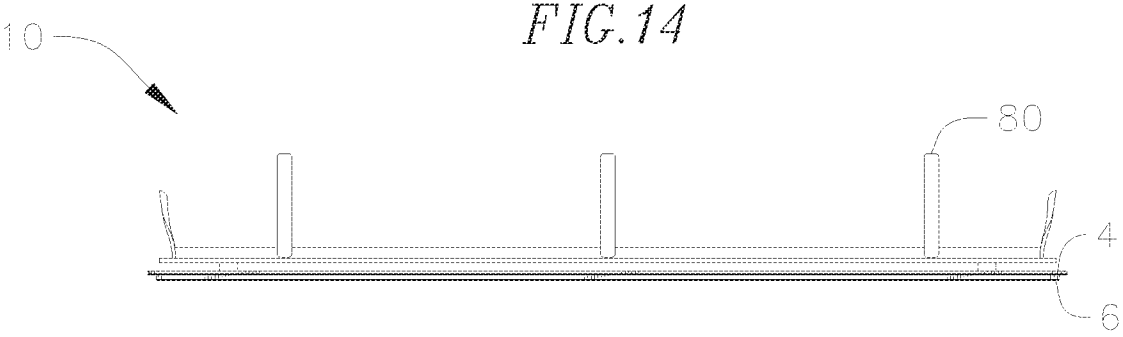
FIG. 14 is a right-side elevational view of the binder of FIG. 9.
Figure 15:
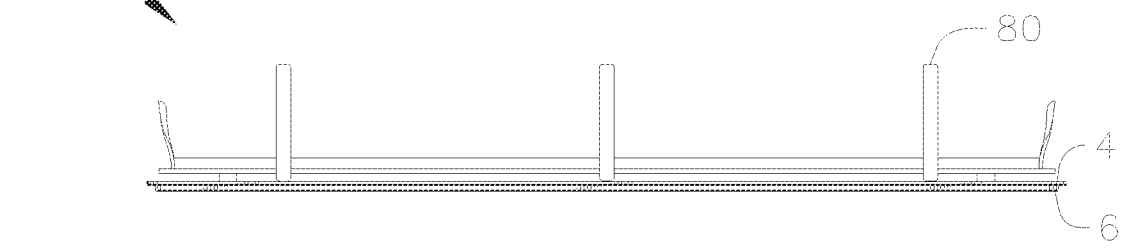
FIG. 15 is a left-side elevational view of the binder of FIG. 9.

As shown in FIGS. 1 and 10, the interior opening 17 can be narrower at the front cover base plate 14 than it is at the front cover interior layer 15. FIG. 11 is a close-up view of the circled portion A of FIG. 10 showing that the interior opening 17 can be narrower at the front cover base plate 14 than it is at the front cover interior layer 15, such that a portion 170 of the front cover base plate 14 can be visible through a portion of the interior opening 17 at the front cover interior layer 15. As described in more detail below, the front cover base plate 14 can be a color different than that of the front cover interior layer 15, such that the portion of the front cover base plate 14 visible through the interior opening 17 improves visibility and identification of the interior opening 17. The front cover base plate 14 can be any color, for example, gray, red, white, black, blue, green, yellow, or any other color or combination of colors, and the front cover interior layer 15 can be any color, for example, gray, red, white, black, blue, green, yellow, or any other color or combination of colors.

Having the interior opening 17 at the interior of the binder 10 prevents the opening from disrupting the smooth, clean lines of the exterior design of the binder. It is less desirable to have the opening to the exterior pocket at the exterior of the binder, since an exterior opening can snag on other objects, become distorted and thereby diminish the aesthetic appeal of the binder, and as discussed above, items stored in such an exterior pocket can fall out of the pocket. Additionally, having the interior opening 17 at the interior of the binder 10 allows the exterior pocket 16 to be loaded from the interior of the binder 10.

Figure 20:
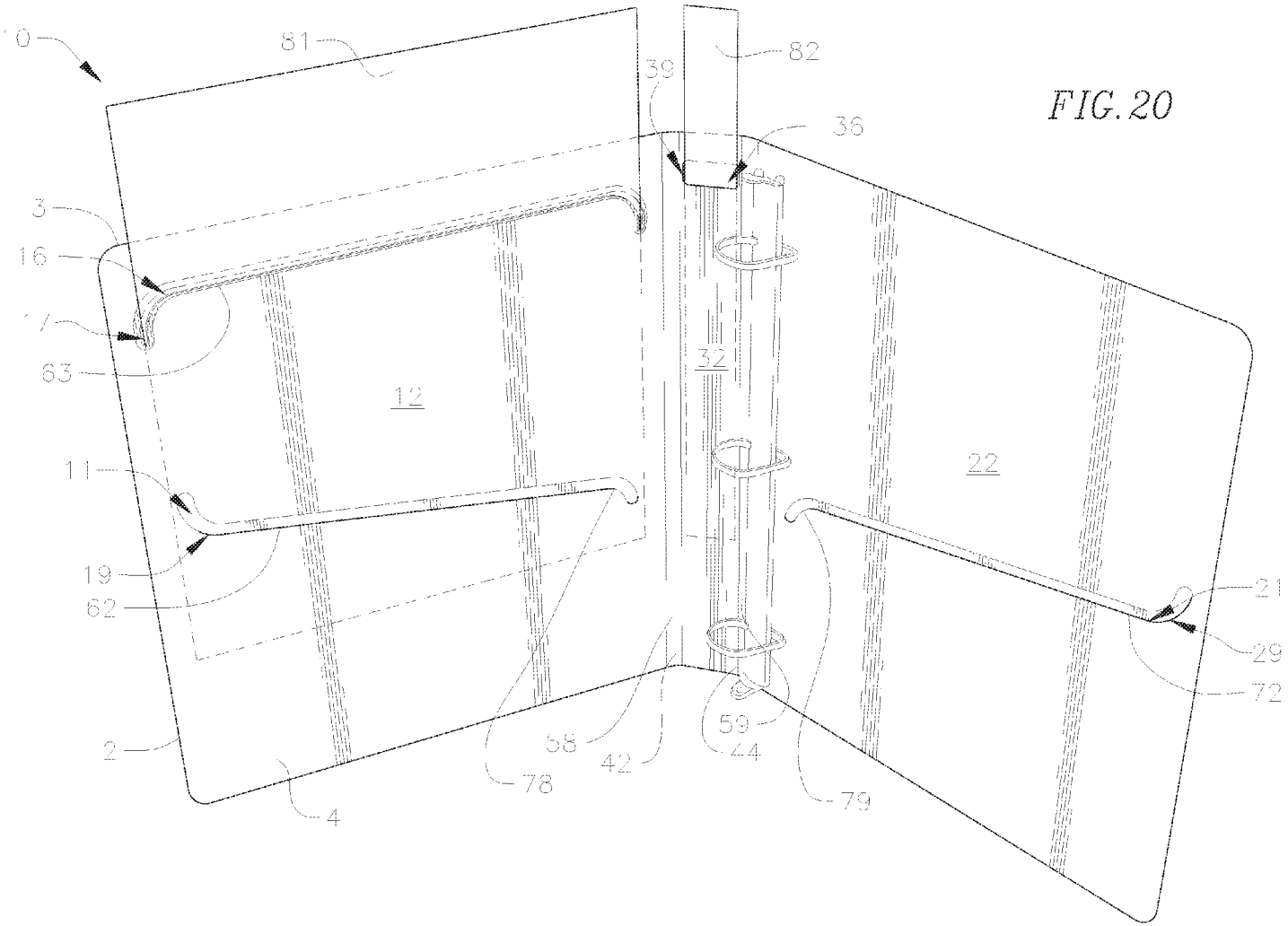
FIG. 20 is a perspective view of the interior of the binder of FIG. 1, in which the exterior pocket and the spine pocket are each shown with an item partially inserted.
Figure 21:
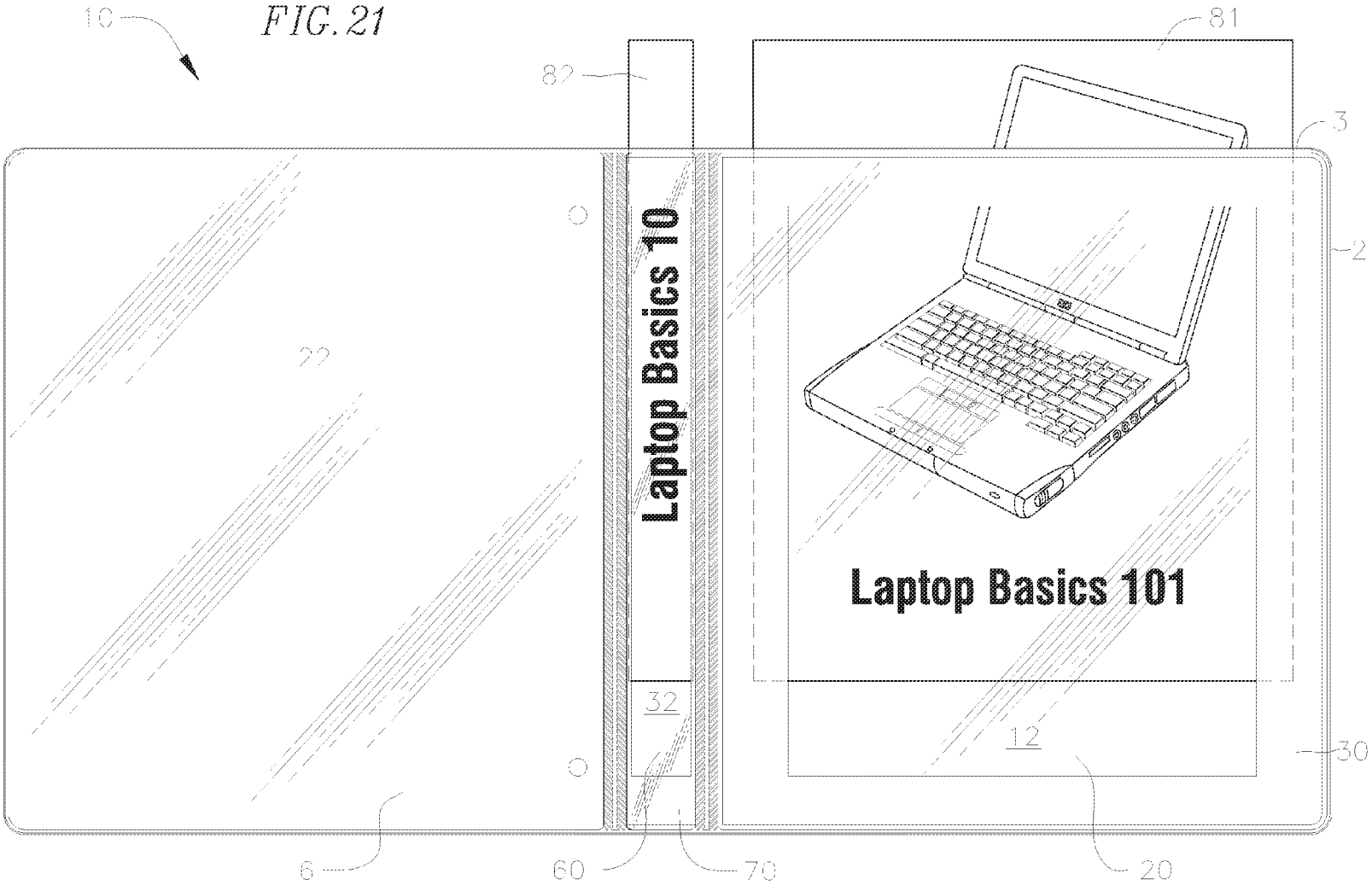
FIG. 21 is a back plan view of the exterior of the binder of FIG. 20, in which the exterior pocket and the spine pocket are each shown with an item partially inserted.

For example, as shown in FIGS. 20 and 21, an item 81, such as a sheet of paper, can be inserted through the interior opening 17 and into the exterior pocket 16. In some embodiments, the front cover exterior layer 13 is transparent or translucent such that the item 81 (e.g., paper, cardstock, photographs, etc.) contained in the exterior pocket 16 can be viewed through the front cover exterior layer 13. The item 81 contained in the exterior pocket 16 can be viewed from the exterior of the binder 10, even when the binder 10 is in a closed position.

As shown in FIG. 21 (and FIG. 3), in some embodiments, the front cover exterior layer 13 includes a front cover display window 20 defined by a front cover display frame 30. As shown in FIG. 3, the front cover display window 20 can have a width $w_{DW}$ and a height $h_{DW}$. The width $w_{DW}$ can be, for example, in a binder designed to hold 8.5 inches (216 mm)×11 inches (280 mm) sheets, about 206 mm wide, and the height $h_{DW}$ can be, for example, about 236 mm tall. The front cover display frame 30 can extend a distance outward from the window a distance $t_{DF}$. The distance $t_{DF}$ can be, for example, about 30 mm. The front cover display frame 30 can be screen printed on the front cover exterior layer 13. For example, the front cover display frame 30 can be screen printed on the inside surface 165 (shown in FIG. 1) of the front cover exterior layer 13 (e.g., the portion of the front cover exterior layer 13 facing the front cover interior layer 15). Alternatively, the front cover display frame 30 can be screen printed on the outside surface 166 (shown in FIG. 2) of the front cover exterior layer 13 (e.g., the portion of the front cover exterior layer 13 facing away from the front cover interior layer 15). In another embodiment, the front cover display frame 30 is an opaque (e.g., colored) polymer layer (e.g., a plastic layer), such as an interlayer 61 described below, cutout at a center to form the front cover display window 20 and bound or welded to the inside or the outside of the front cover exterior layer 13. The front cover display frame 30 can be any color, for example, gray, red, white, black, blue, green, yellow, or any other color or combination of colors. When the front cover display window 20 is included, an item 81 contained in the exterior pocket 16 can be framed by the front cover display frame 30 in an aesthetically pleasing manner.

Figure 22:
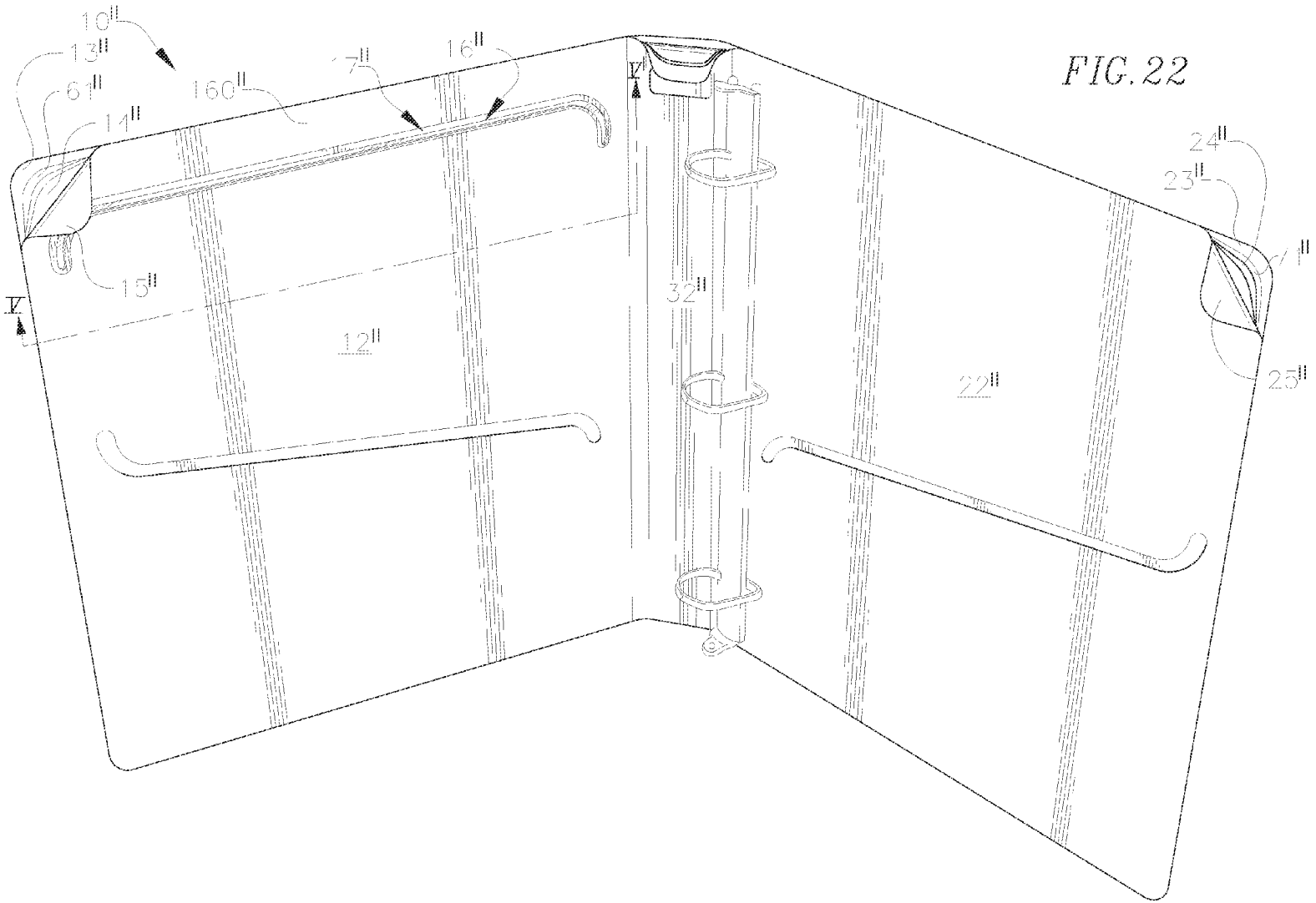
FIG. 22 is a perspective (partially peeled-away) view of the interior of the binder of FIG. 1 including an interlayer according to another embodiment of the invention.
Figure 23:
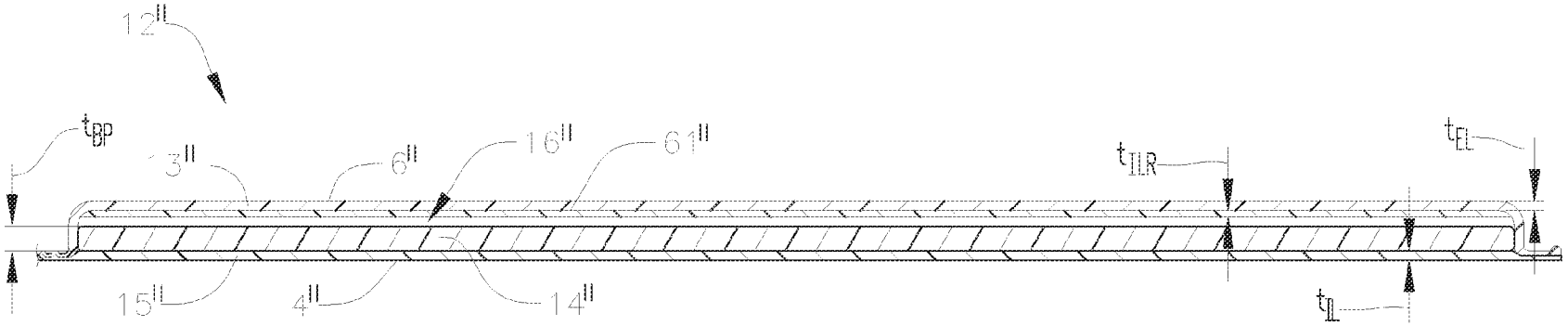
FIG. 23 is a cross-sectional view of the front cover of the binder of FIG. 22 cut along the line V-V'.

According to another embodiment of the invention, shown in FIGS. 22 and 23, a front cover 12" can also include a front cover interlayer 61" between an exterior layer 6" (e.g., a front cover exterior layer 13") and a front cover base plate 14". The front cover 12" also includes an interior layer 4" (e.g., a front cover interior layer 15"). Embodiments of the invention that include the front cover interlayer 61", have a front cover 12" having improved stiffness and durability as compared to a front cover 12 that does not include the interlayer 61". For example, when present, the front cover interlayer 61" provides additional stiffness to the front cover 12", and it reduces the amount of wear that would otherwise result from contact of the front cover exterior layer 13" with the front cover base plate 14". The additional stiffness provided by the front cover interlayer 61" can be particularly desirable for a top 160" of the front cover 12". In some embodiments, the front cover exterior layer 13" is transparent or translucent such that an item, such as the item 81 (e.g., paper, cardstock, photographs, etc.) of FIGS. 20 and 21, contained in an exterior pocket 16" can be viewed through the front cover exterior layer 13" and, if present, the front cover interlayer 61". The item (e.g., the item 81) can be inserted into the exterior pocket 16" through an interior opening 17". In other embodiments, the front cover interlayer 61", or a portion of the front cover interlayer 61", can be opaque (e.g., colored). For example, as described above, the front cover interlayer 61" can correspond to the front cover display frame 30 shown in FIG. 2, and a center portion of the front cover interlayer 61" (e.g., a portion of the interlayer 61" that is shaped and positioned similarly to the front cover display window 20 shown in FIG. 2) can be transparent or translucent, or cutout, to correspond to the front cover display window 20 shown in FIG. 2. Similarly to the front cover interlayer 61", as shown in FIG. 22, a back cover 22", which is coupled to the front cover 12" through a spine 32" can also include a back cover interlayer 71" between the exterior layer 6" (e.g., a back cover exterior layer 23") and a back cover base plate 24". The back cover 22" also includes the interior layer 4" (e.g., a back cover interior layer 25"). The back cover interlayer 71" can have characteristics and design similar to those of the front cover interlayer 61". The front cover interlayer 61" and the back cover interlayer 71" can be included together or independently. The front cover interlayer 61" and the back cover interlayer 71" can include any suitable polymer, such as, but not limited to, polyolefins (e.g., polyethylene or polypropylene), polyesters and plastics.

Figure 24:
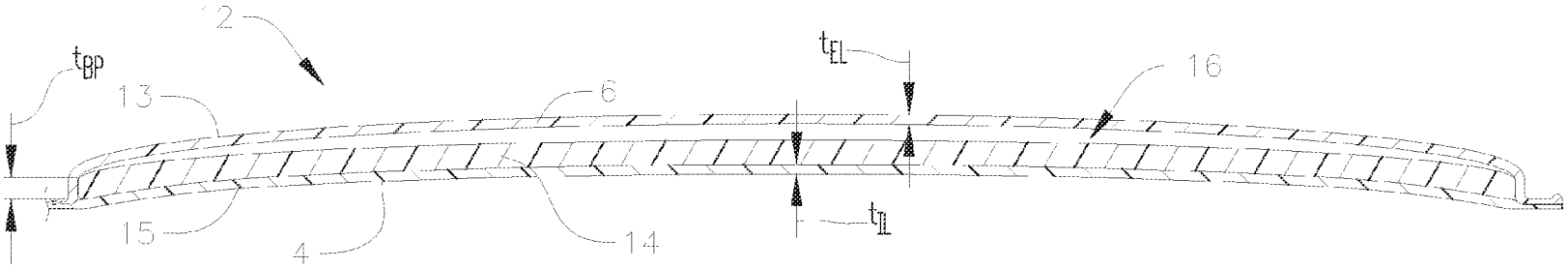
FIG. 24 is a cross-sectional view of another embodiment of the front cover of the binder of FIG. 3 cut along the line I-I'.

The above-described front cover exterior layer 13 (or the front cover exterior layer 13" and the front cover interlayer 61") can exhibit properties of contact clarity, in which items that are not in direct physical contact with the front cover exterior layer 13 (or the front cover interlayer 61") may not be as clearly visible as items that are in direct physical contact. For example, items that are not in direct physical contact with the front cover exterior layer 13 (or the front cover interlayer 61") can appear hazy and printed material on the item can be difficult to read. To improve the clarity of the image viewed through the front cover exterior layer 13 (or the front cover exterior layer 13" and the front cover interlayer 61"), the front cover base plate 14 (or the front cover base plate 14") can be bowed out toward the front cover exterior layer 13. For example, as shown in FIG. 24, the front cover base plate 14 can be convex (or have a slight outward bow) with respect to the front cover exterior layer 13, which presses an item (e.g., the item 81 shown in FIGS. 20 and 21) contained in the exterior pocket 16 against the front cover exterior layer 13 (or front cover interlayer 61"), thereby improving the visibility of the item from the exterior of the binder 10 (or the binder 10"). In some embodiments, when the front cover base plate 14" is flat and the front cover interlayer 61" is thick enough to stiffen the front cover 12", an item (e.g., the item 81) viewed through the front cover exterior layer 13" and the front cover interlayer 61" may appear cloudy (e.g., the contact clarity may be reduced). In other embodiments, when the front cover base plate 14" is bowed out toward the front cover exterior layer 13" and the front cover interlayer 61" is thick enough to stiffen the front cover 12", the item (e.g., the item 81) may be viewed through the front cover exterior layer 13" and the front cover interlayer 61" with improved contact clarity, relative to the embodiment in which the front cover base plate 14" is flat.

Figure 25:
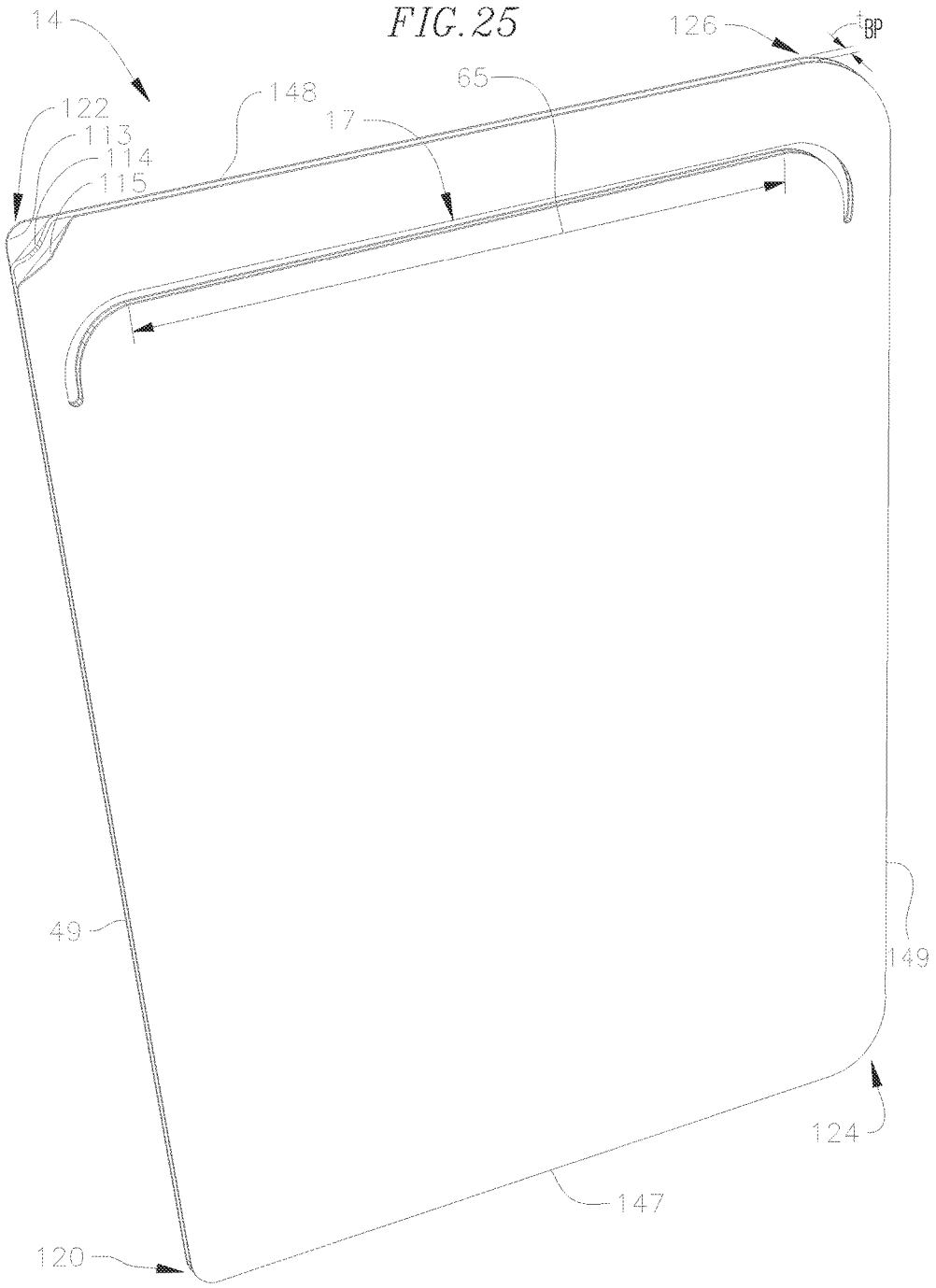
FIG. 25 is a perspective (partially peeled-away) view of a front cover base plate according to an embodiment of the invention.

The front cover base plate 14 and the back cover base plate 24 may each independently include a foamed polymer layer, such as, for example, foamed polypropylene (PP), foamed polyethylene, foamed polystyrene, or any other suitable foamed polymer layer. Each foamed polymer layer can independently be sandwiched between two outer skin layers of a compatible polymer, such as, for example, PP skins and a PP foamed polymer layer. For example, FIG. 25 shows the front cover base plate 14 including a foamed polymer layer 114 between two outer skin layers. In FIG. 25, the two outer skin layers include an exterior skin layer 113 and an interior skin layer 115. The front cover base plate 14 includes the opening 17 through the front cover base plate 14 having the central portion 65. The two outer skin layers can independently be colored. For example, either or both of the two outer skin layers (e.g., the exterior skin layer 113 and the interior skin layer 115) can be any color, for example, gray, red, white, black, blue, green, yellow, or any other color or combination of colors. As shown in FIG. 25, the front cover base plate 14 can have a thickness $t_{BP}$. For example, $t_{BP}$ can be in a range of about 1.5 mm to about 3 mm, for example, about 2 mm. The back cover base plate 24 can have a thickness $t_{BP}$, which can be in a range of about 1 mm to about 3 mm, for example, about 2 mm. In some embodiments, the color of the two outer skin layers (e.g., the exterior skin layer 113 and the interior skin layer 115) is different from the color of the interior layer 4. Additionally, in some embodiments, one of the outer skin layers (e.g., the interior skin layer 115) is visible through any or all of the openings in the interior layer (e.g., the interior opening 17, the front cover interior opening 19, and/or the back cover interior opening 29) and, therefore, by having a color different from that of the interior layer, the outer skin layer can improve the visibility of each of the opening described herein. Additionally, if the base plate 14 or 24 is clear (e.g., transparent or translucent) items contained in the interior of the binder (e.g., in the interior pockets or ring mechanism) would be visible from the exterior of the binder 10, thereby compromising privacy, and the openings 17, 19, and 29 in the interior would also be visible, thereby disrupting the design aesthetics of the binder 10.

Additionally, the above-described front cover interlayer 61 can reduce wear on the front cover exterior layer 13 that would otherwise result from contact between the front cover base plate 14 and the front cover exterior layer 13. For example, if the front cover interlayer 61 is not included, the edges 49, 147, 148, and 149 of the base plate 14 (which can be hard die cut edges) can contact the exterior layer 6 resulting in wear points (or wear areas). As described above, the front cover interlayer 61 can be transparent or translucent. The front cover interlayer 61 can include a polymer layer, such as, for example, polyolefins (e.g., polyethylene or polypropylene), polyesters, or any other suitable clear, transparent or translucent polymer, polymer blend, plastic, or plastic blend. The front cover interlayer 61 can have a thickness $t_{ILR}$ (see FIG. 23) in a range of about 0.1 to about 0.45 mm, such as, for example, a thickness of about 0.18 mm.

The hinges 42 and 44 can be relatively wider than the hinges of a traditional binder, which reduces the amount of wear on the binders according to embodiments of the invention. In a traditional binder, the corners of the hinges, front cover, and back cover (e.g., corners that are positioned similarly to the corners 102, 104, 106, 108, 120, 122, 124, 126, 128, 130, 132, and 134 shown in FIGS. 1, 7, 16, and 25) are exposed significant stress, wear and tear. By making the hinges 42 and 44 relatively wider than the hinges of a traditional binder, the amount of wear that would otherwise result from the base plates 14 and 24 interacting with the hinges 42 and 44 can be reduced. For example, the stress from use of the binder 10 decreases as the outer edges 31 and 37 (shown in FIG. 16) of the hinges 44 and 42, respectively, are positioned further toward the center of the back cover 22 and the front cover 12, respectively (e.g., as the width of each of the hinges 42 and 44 is increased). Thus, making the hinges 42 and 44 relatively wider can reduce the amount of wear on the hinges 42 and 44 and the exterior layer 6 (e.g., the front exterior layer 13 and/or the back cover exterior layer 23). For example, by having the hinges 42 and 44 relatively wider than the hinges of a traditional binder, the amount of wear expected to occur at corners 102, 104, 106, and 108 (shown in FIG. 16) of the exterior layer 6 can be reduced as compared to the amount of wear that would be expected to occur at the corresponding corners of a traditional binder having relatively narrower hinges.

Embodiments of the present invention include base plates having inner corners that are approximately square-shaped or have a small radius of curvature (e.g., a radius of curvature that is relatively smaller than a radius of curvature of outer corners of the respective base plates) to improve sealing in the binder 10. For example, as shown in FIG. 25, the front cover base plate 14 can have inner corners 120 and 122, and outer corners 124 and 126, and the inner corners 120 and 122 can have a radius of curvature (e.g., less than about one eighth of an inch (3.18 mm)) that is relatively smaller than a radius of curvature of the outer corners 124 and 126. By being approximately square-shaped or by having a relatively smaller radius of curvature the inner corners 120 and 122 can be positioned relatively closer to corners of the first hinge 42 (e.g., corners 136 and 138, respectively, as seen in FIG. 3) than if the inner corners 120 and 122 had the larger radius of curvature of outer corners 124 and 126. By positioning the inner corners 120 and 122 relatively closer to the corners 136 and 138, respectively, of the first hinge 42, the area between the inner corners 120 and 122 and the corners 136 and 138, respectively, that has to be sealed is reduced, thereby improving sealing of the binder. In contrast, when the inner corners 120 and 122 are not approximately square-shaped or have a relatively larger radius of curvature (e.g., larger than about one eighth of an inch (3.18 mm)), the inner corners 120 and 122 are positioned relatively farther away from the corners 136 and 138, respectively, resulting in a sealing area that is disproportionately larger than the other sealed surfaces, making it more difficult to create an effective seal and creating a soft area that can be easily bent or damaged, which would impair the design aesthetics of the binder. As used herein, the term "effective seal" refers to a seal (e.g., two or more layers that have been permanently bonded together, for example by melting through RF, heat seal, or ultrasonic welding) that does not separate under normal use.

Figure 7:
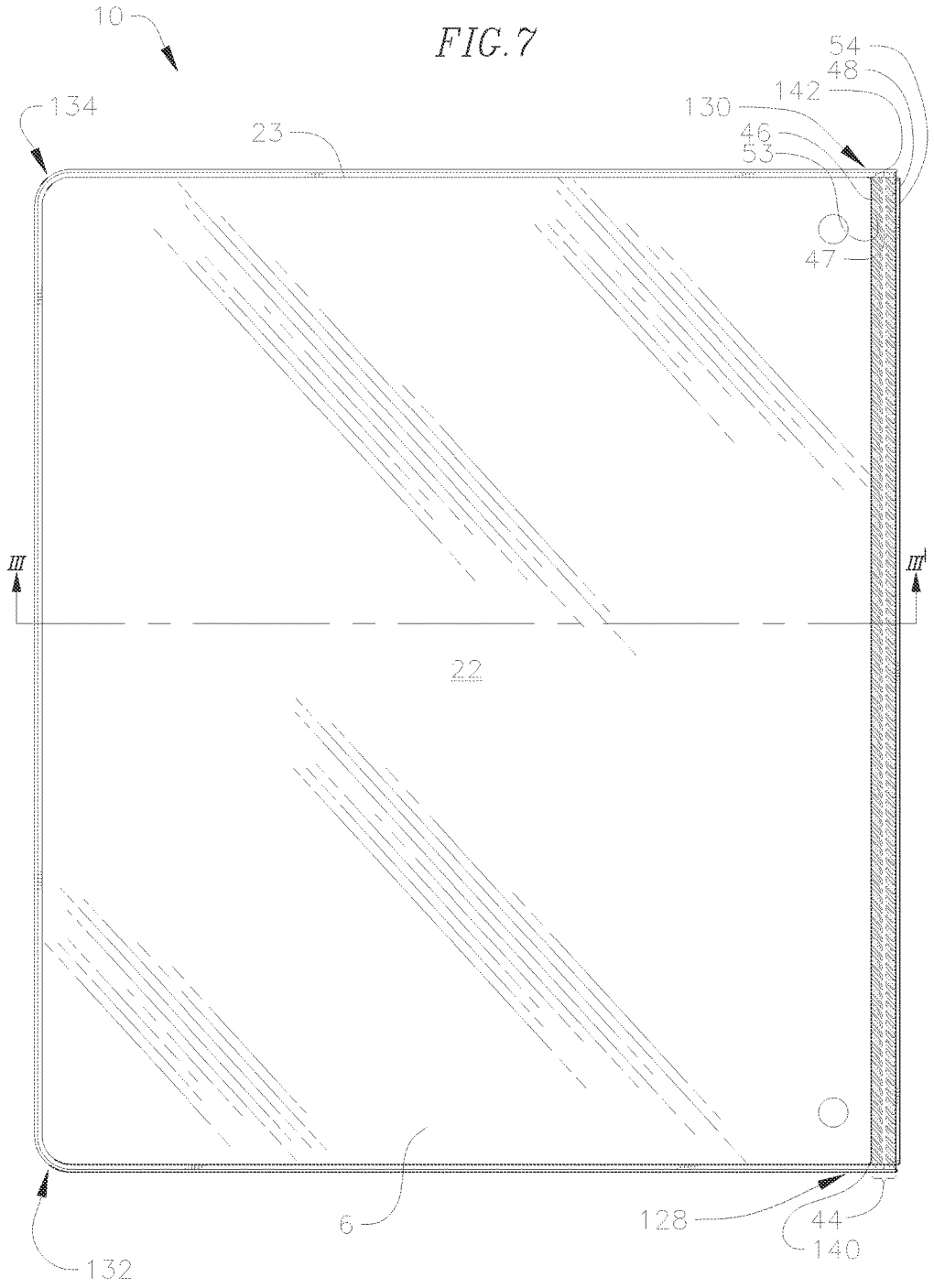
FIG. 7 is a back plan view of the binder of FIG. 1 in a closed position.
Figure 8:
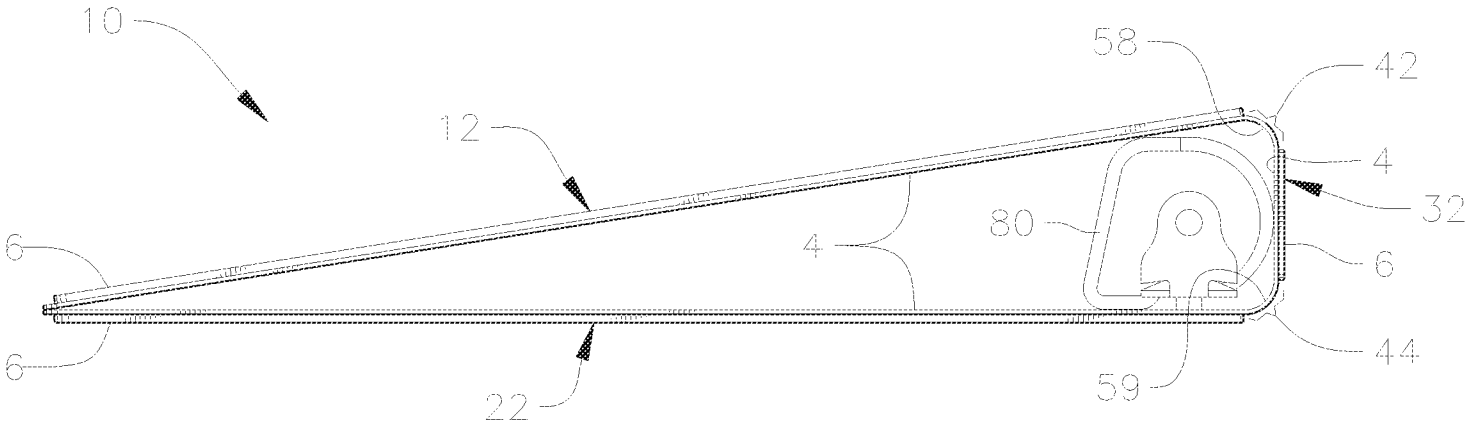
FIG. 8 is a top elevational view of the binder of FIG. 1 in a closed position.
Figure 9:
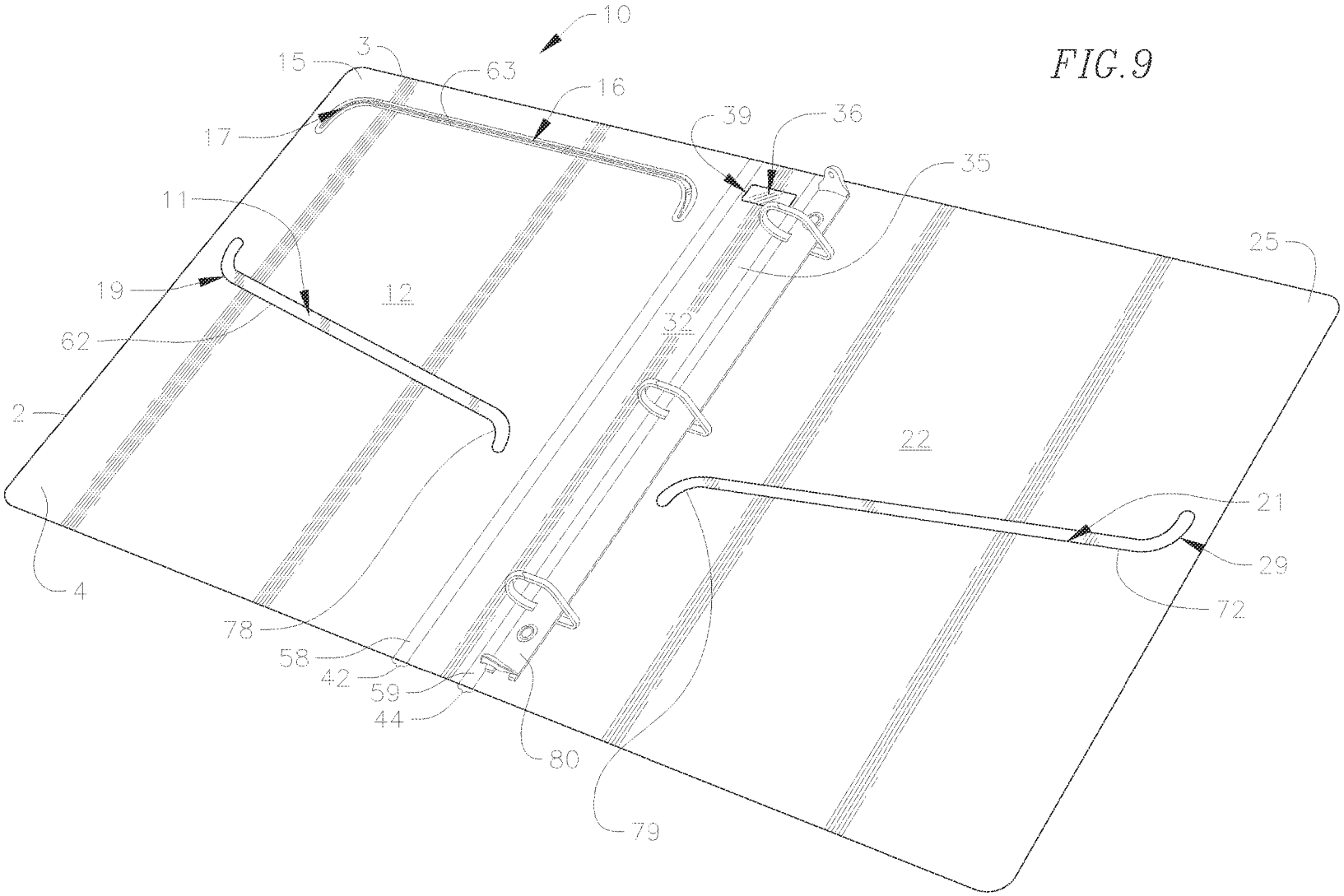
FIG. 9 is a perspective view of the binder of FIG. 1 in a fully open and flat position.

Similarly, as shown in FIGS. 1 and 7, the back cover base plate 24 can have inner corners 128 and 130, and outer corners 132 and 134, and the inner corners 128 and 130 can be approximately square-shaped or have a radius of curvature (e.g., less than about one eighth of an inch (3.18 mm)) that is relatively smaller than a radius of curvature of the outer corner 132 and 134. By being approximately square-shaped or by having a relatively smaller radius of curvature the inner corners 128 and 130 to corners of the second hinge 44 (e.g., corners 140 and 142, respectively) than if the inner corners 128 and 130 had the larger radius of curvature of outer corners 132 and 134. By positioning the inner corners 128 and 130 relatively closer to the corners 140 and 142, respectively, of the second hinge 44, the area between the inner corners 128 and 130 and the corners 140 and 142, respectively that has to be sealed is reduced, thereby improving sealing of the binder. In contrast, when the inner corners 128 and 130 are not approximately square-shaped or have a relatively larger radius of curvature (e.g., larger than about one eighth of an inch (3.18 mm)), the inner corners 128 and 130 are positioned relatively farther away from the corners 140 and 142, respectively, resulting in a sealing area that is disproportionately larger than the other sealed surfaces, which makes it more difficult to create an effective seal, can create a soft area that can be easily bent or damaged, and can impair the design aesthetics of the binder. While having inner corners that are approximately square-shaped or inner corners having a relatively smaller radius of curvature improves sealing, the particular dimensions and shape of the inner corners are not critical and, thus, the particular dimensions and shape can be selected for aesthetic reasons.

Figure 26:
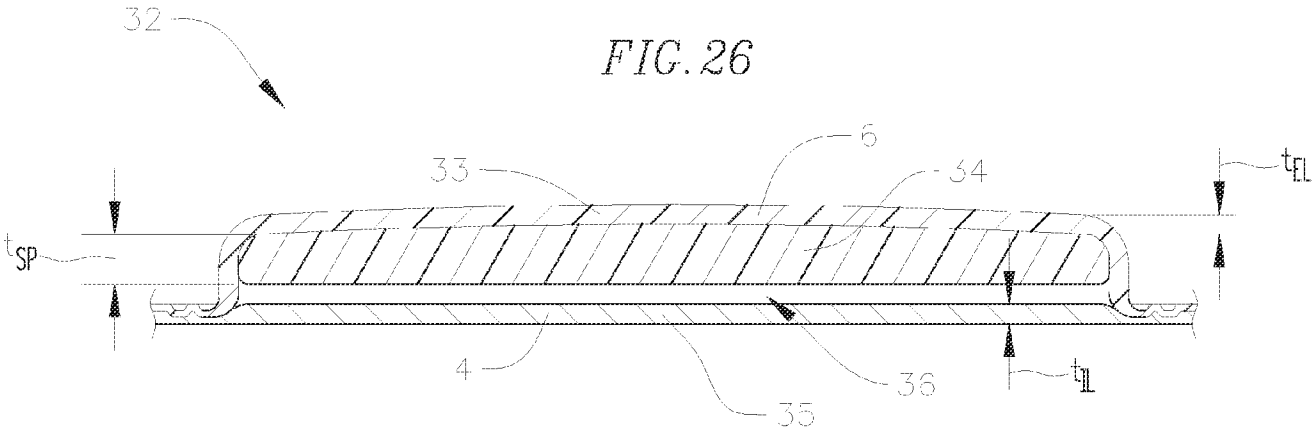
FIG. 26 is a cross-sectional view of the spine of the binder of FIG. 5 cut along the line II-II'.

As shown in FIG. 26, in some embodiments, the spine 32 includes a spine pocket 36. The spine pocket 36 can be between the spine panel 34 and the spine interior layer 35. Referring back to FIG. 1, the spine 32 can also include a spine interior opening 39 through the spine interior layer 35. In an alternative embodiment, shown in FIG. 27, a spine 32''' includes a spine pocket 36''' between an exterior layer 6''' (e.g., a spine exterior layer 33''') and a spine panel 34''', and a spine interior opening (e.g., a spine interior opening corresponding to the spine interior opening 39 shown in FIG. 1) passes through both an interior layer 4''' (e.g., a spine interior layer 35''') and the spine panel 34'''. Similarly to the spine interior opening 39 (shown in FIG. 1) described above, the spine interior opening can have any suitable shape, such as the shape of a rounded rectangle, a squared rectangle, an oval, or any other suitable shape, and it can be located at the top of the spine interior layer 35'''.

Having the spine interior opening 39 at the interior of the binder 10 (as shown in FIG. 1) prevents the spine interior opening 39 from disrupting the smooth, clean lines of the exterior design of the binder 10. Additionally, having the spine interior opening 39 at the interior of the binder 10 allows the spine pocket 36 to be loaded from the interior of the binder 10.

For example, as shown in FIGS. 20 and 21, the item 82, such as a narrow display sheet (e.g., cardstock, paperboard, or paper), can be inserted through the spine interior opening 39 and into the spine pocket 36. As shown in FIG. 21, in some embodiments, the front spine exterior layer 33 and spine panel 34 are transparent or translucent such that the item 82 (e.g., paper, cardstock, photographs, etc.) contained in the spine pocket 36 can be viewed through the spine exterior layer 33 and the spine panel 34. Alternatively, the item can be between the spine exterior layer 33 and the spine panel 34, and the spine panel 34 can be opaque as the item can be viewed from the exterior of the binder through the spine exterior layer 33. For example, the spine exterior layer 33 can be a transparent or translucent polymer layer and the polymer layer can include a polymer, such as EPPE, or a blend thereof, such as a blend of EPPE and ethylene vinylene acetate (EVA) or any other material that can be RF, heat seal, or ultrasonically welded, such as polypropylene or polyvinyl chloride, but the present invention is not limited thereto. The spine panel 34 can be a transparent or translucent polymer layer and the polymer can include a polymer, such as clear extruded PP, a blend thereof, or any other suitable polymer or plastic that is clear, transparent or translucent. The spine panel 34 can have a thickness $T_{sp}$ (shown in FIG. 26) in a range of about 1 to about 2 mm, for example, about 1 mm. As shown in FIG. 21, the item (e.g., the item 82) contained in the spine pocket 36 can be viewed from the exterior of the binder 10, even when the binder 10 is in a closed position.

Figure 5:
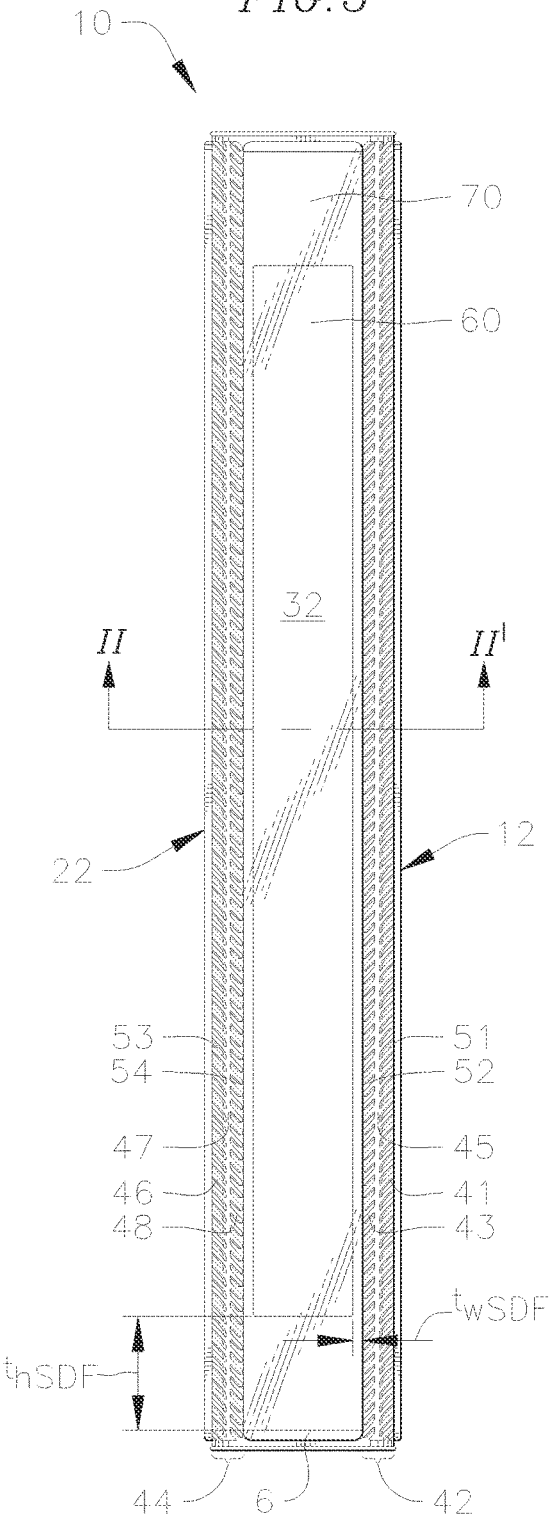
FIG. 5 is a right-side elevational view of the binder of FIG. 1 in a closed position.
Figure 6:
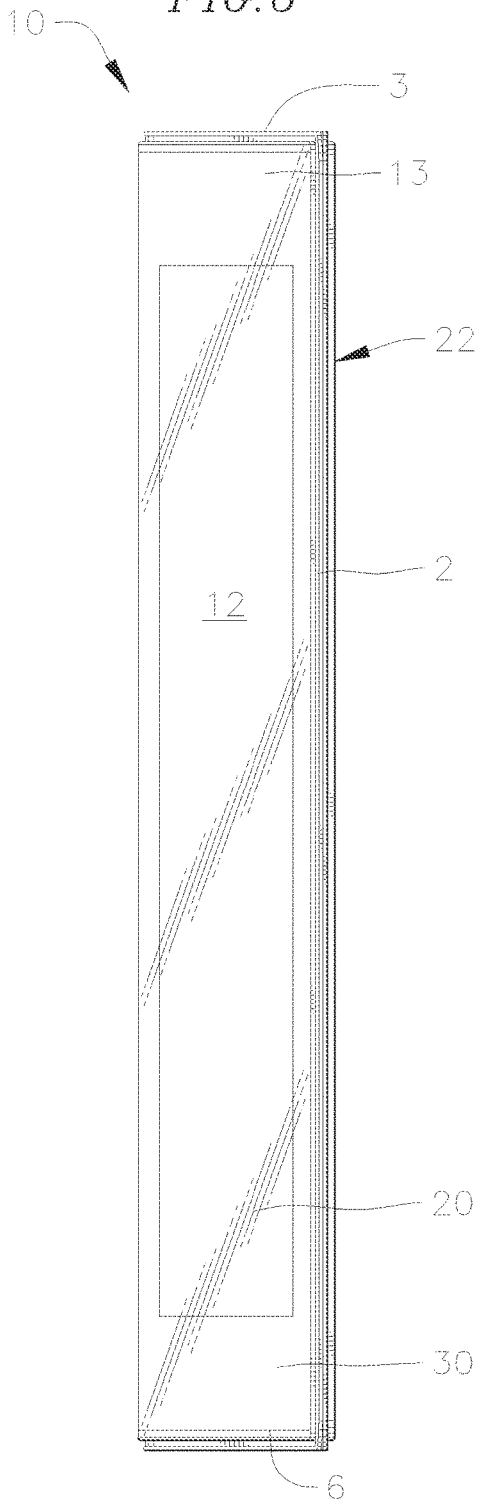
FIG. 6 is a left-side elevational view of the binder of FIG. 1 in a closed position.

Referring back to FIGS. 1 and 2, in some embodiments, the spine exterior layer 33 includes a spine display window 60 defined by a spine display frame 70. The spine display frame 70 can be screen printed on the spine exterior layer 33. In some embodiments, the spine display frame 70 is screen printed on an inside surface 161 of the spine exterior layer 33 (e.g., on the portion of the spine exterior layer 33 facing the spine interior layer 35). Alternatively, the spine display frame 70 can be screen printed on an outside surface 162 of the spine exterior layer 33 (e.g., the portion of the spine exterior layer 33 facing away from the spine interior layer 35). In another, embodiment, the spine display frame 70 is an opaque or colored polymer layer (e.g., a plastic layer) cutout at a center to form the spine display window 60 and bound or welded to the inside or the outside of the spine exterior layer 33. The spine display frame 70 can be any color, for example, gray, red, white, black, blue, green, yellow, or any other color or combination of colors. As shown in FIG. 5, the spine display frame 70 can extend a distance $t_{hSDF}$ in a vertical direction from the spine display window 60. The spine display frame 70 can also extend a distance $t_{wSDF}$ in a horizontal direction from the spine display window 60. For example, in a binder designed to hold 8.5 inches (216 mm)×11 inches (280 mm) sheets, the spine display frame 70 can extend a distance $t_{wSDF}$ of about 4 mm in a horizontal direction from each side of the spine display window 60, and the spine display frame 70 can extend a distance $t_{hSDF}$ of about 30 mm in a vertical direction from each of a top and a bottom of the spine display frame 70. The spine display frame 70 can be screen printed on the spine exterior layer 33 in a manner similar to the front cover display frame 30, as described previously. When the spine display window 60 is included, items 82 contained in the spine pocket 36 can be framed by the spine display frame 70 in an aesthetically pleasing manner.

As shown in FIG. 10 (and FIGS. 1, 9 and 16), the front cover 12 can also include a front cover interior pocket 11 and a front cover interior opening 19 to the front cover interior pocket 11. The front cover interior pocket 11 can be between the front cover base plate 14 and the front cover interior layer 15. In some embodiments, the back cover 22 includes a back cover interior pocket 21 and a back cover interior opening 29 to the back cover interior pocket 21. The back cover interior pocket 21 can be between the back cover base plate 24 and the back cover interior layer 25. The interior openings 19 and 29 can be s-shaped (e.g., f-shaped), and they can each be located at or just below respective horizontal centers of the front cover 12 and the back cover 22. As shown in FIG. 10, as a result of the interior opening 19 having an s-shape, the front cover interior layer 15 can have a curved portion 78. The curved portion 78 can bend along a line 180 that extends from one end 181 of the curved portion 78 to another end 182 of the curved portion 78, thereby allowing a user to pick up the curved portion 78 of the front cover interior layer 15 and fold it back to facilitate insertion of items (e.g., item 83) into the front cover interior pocket 11. Similarly, as a result of the interior opening 29 having an s-shape, the back cover interior layer 25 can have a curved portion 79. The curved portion 79 can bend along a line 183 that extends from one end 184 of the curved portion 79 to another end 185 of the curved portion 79, thereby allowing a user to pick up the curved portion 79 of the back cover interior layer 25 and fold it back to facilitate insertion of items (e.g., item 84) into the back cover interior pocket 21.

Figure 28:
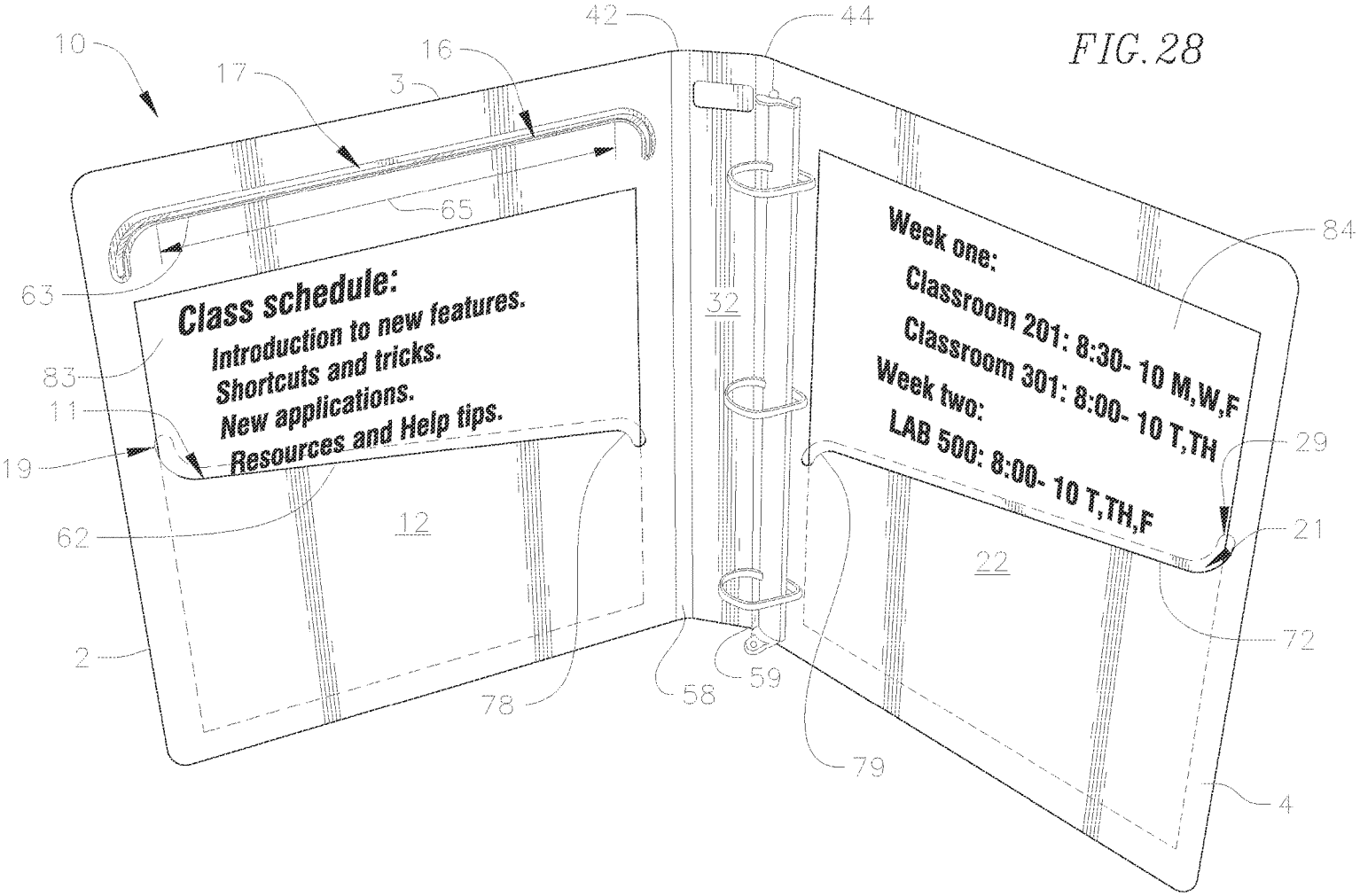
FIG. 28 is a perspective view of the interior of the binder of FIG. 1, in which the front cover interior pocket and the back cover interior pocket are each shown with an item partially inserted.

The interior pockets 11 and 21 are configured to be easy loading, high capacity pockets. For example, the interior openings 19 and 29 can be wide to allow for easy loading of items (e.g., sheets of paper, cardstock, etc.) into the respective pockets 11 and 21. For example, FIG. 28, shows an item 83 being loaded into the front cover interior pocket 11 by way of the front cover interior opening 19 and an item 84 being loaded into the back cover interior pocket 21 by way of the back cover interior opening 29.

In some embodiments, a material of the front cover interior layer 15 is different from a material of the front cover base plate 14 and a material of the back cover interior layer 25 is different from a material of the back cover base plate 24, such that the materials defining opposing surfaces of the pockets 11 and 21 can be different to prevent or reduce blocking. Blocking occurs when the materials defining the pocket stick together (or adhere to one another), which makes it more difficult for a user to access and use the pocket. Traditional binders typically use similar materials (or even the same materials) to construct interior pockets since it is easier to seal materials that are the same or similar together. However, materials that are the same or similar are more likely to stick together or block. According to some embodiments of the invention, the materials defining the opposing surfaces of the interior pockets 11 and 21 are different (as described above), thereby preventing or reducing the likelihood of blocking. For example, the interior layer 4 of the binder 10 can be EPPE (or a blend thereof, such as a blend of EPPE and ethylene vinyl acetate), while the base plate 14 can be foamed PP and the outer skins 113 and 115 can be PP. Thus, the interior pockets 11 and 21 can be formed or positioned between an EPPE layer (and an EPPE blend layer) and a PP layer, thereby preventing or reducing the likelihood of blocking.

Figure 29:
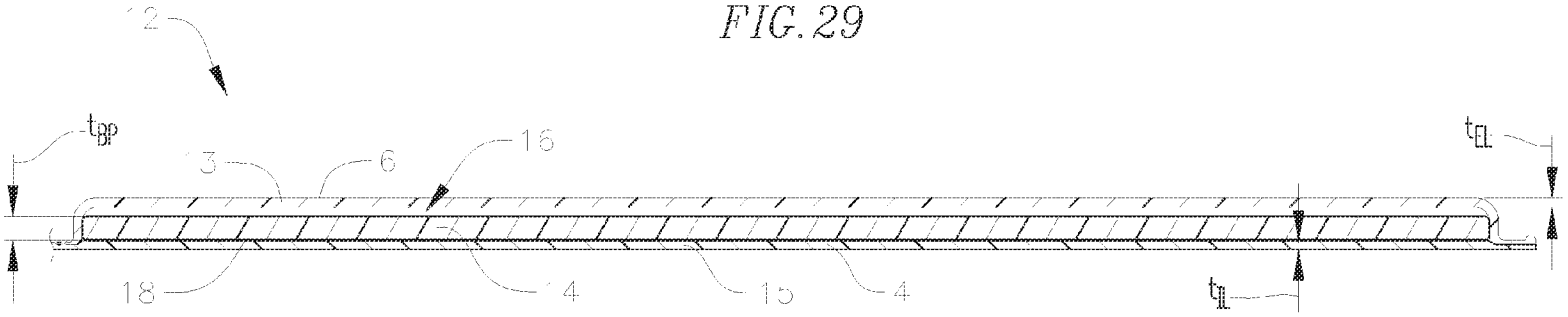
FIG. 29 is a fragmentary cross-sectional view of another embodiment of the front cover of the binder of FIG. 3 cut along the line I-I'.
Figure 30:
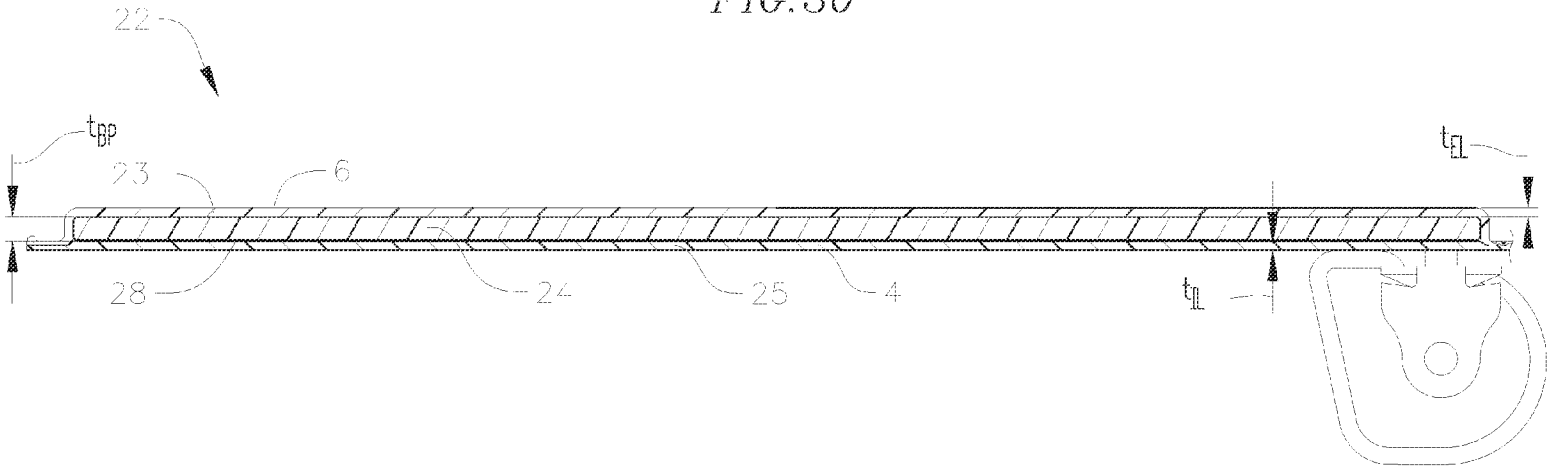
FIG. 30 is a cross-sectional view of another embodiment of the back cover of the binder of FIG. 7 cut along the line III-III'.

The portions of the interior layer 4 and the portions of the base plates 14 and 24 outside of the pockets 11 and 21 can be adhered together with adhesives 18 and 28, respectively, to help define the respective pockets 11 and 21, and to improve the aesthetics of the binder interior. Additionally, portions of the interior layer 4 and the portions of the base plate 14 outside of the interior opening 17 can be adhered together with adhesive 118. In FIG. 1, the adhesives 18 and 118 are shown with hidden lines beneath the front cover interior layer 15, and the adhesive 28 is shown with hidden lines beneath the back cover interior layer 25. As can be seen in FIG. 1, the adhesives 18 and 118 can be included as narrow strips that extend across the front cover 12, and the adhesive 28 can be included as a narrow strip that extends across the back cover 24. The adhesive 118 can be included as two narrow strips, one of which is positioned above the interior opening 17 and the other of which is positioned below the interior opening 17. As shown in FIG. 29, the adhesive 18 can be between the interior layer 4 (e.g., the front cover interior layer 15) and the front cover base plate 14. The adhesive 118 can be between the interior layer 4 (e.g., the front cover interior layer 15) and the front cover base plate 14 in a manner similar to that shown in FIG. 29 for the adhesive 18. As shown in FIG. 30, the adhesive 28 can be between the interior layer 4 (e.g., the back cover interior layer 25) and the back cover base plate 24. The adhesives 18, 28, and 118 can each independently be a pressure sensitive adhesive or pressure sensitive adhesive tape (e.g., fabricating tape) configured to adhere to the interior layer 4 (e.g., the front cover interior layer 15 or the back cover interior layer 25) and the base plates (e.g., the front cover base plate 14 or the back cover base plate 24). The pressure sensitive adhesive or pressure sensitive adhesive tape can include a permanent pressure sensitive adhesive. The pressure sensitive adhesive or pressure sensitive adhesive tape can be any suitable pressure sensitive adhesive or pressure sensitive adhesive tape, such as FT8374 available from Avery China Company, Ltd. located in Shanghai, People's Republic of China. Prior to being applied to a component (e.g., the front cover interior layer 15, the back cover interior layer 25, and/or an outer skin of a base plate, such as the outer skin 115 of the base plate 14) of the binder 10, the pressure sensitive adhesive can be included between two release liners and the pressure sensitive adhesive can be applied by peeling off one release liner, applying one side of the pressure sensitive adhesive to a component of the binder 10, peeling of the other release liner and applying another component of the binder 10 to the other side of the pressure sensitive adhesive.

Additionally, as described above, the base plates 14 and 24 can each have an outer skin (e.g., outer skin 113 or 115) that has a color that is different from that of the interior layer 4. As such, the outer skin (e.g., outer skin 113 or 115) of each base plate 14 and 24 and the interior layer can be contrasting colors. Because a portion of the base plates 14 and 24 (or the outer skins thereof) is visible through the respective front and back interior openings 19 and 29, the contrasting colors allow a user to more easily see the interior openings 19 and 29, thereby making it easier for the user to see and use the interior pockets 11 and 21.

The interior openings 19 and 29 to the respective interior pockets 11 and 21 can each be positioned diagonally with respect to an edge of the binder (e.g., a front cover top edge 3 or back cover top edge 5, as shown in FIG. 1). For example, as shown, a side 150 of the front cover interior opening 19 can be closer to the top edge 3 of the front cover 12 than a side 152 of the front cover interior opening 19. Similarly, a side 154 of the back cover interior opening 29 can be closer to the top edge 5 of the back cover 22 than a side 156 of the back cover interior opening 29.

In a traditional binder, the interior pocket openings are often horizontally positioned with respect to a top or bottom edge of the binder. As a result of that horizontal positioning, paper or other items loaded in the pocket can roll or flop over. In contrast, by positioning the interior openings 19 and 29 diagonally with respect to an edge (e.g., the top edge 3 or top edge 5) of the binder 10 according to the above-described embodiments, the interior pockets 11 and 21 can provide a "vertical hold" for items (e.g., items 83 and 84) such as sheets of paper that are held within the interior pockets. As a result of the diagonal positioning of interior opening 19, a bottom edge 62 of interior opening 19 has a vertical component (as opposed to having only a horizontal component) that vertically contacts an item (e.g., item 83) inserted in interior pocket 11, and reduces the likelihood that the item, such as a sheet of paper, will flop or roll over. Similarly, as a result of the diagonal positioning of interior opening 21, a bottom edge 72 of interior opening 29 has a vertical component (as opposed to having only horizontal component) that vertically contacts an item (e.g., an item 84) inserted in interior pocket 21, and reduces the likelihood that the item, such as a sheet of paper, will flop or roll over. For example, referring back to FIG. 28, the item 83 (e.g., a sheet of paper) held in the front cover interior pocket 11 has a diagonal line of contact with a bottom edge 62 of the front cover interior pocket opening 19 and the item 83 is less likely to roll or flop over. Additionally, as shown in FIG. 28, the item 84 (e.g., a sheet of paper) held in the back cover interior pocket 21 diagonally contacts a bottom edge 72 of the back cover interior opening 29 and the item 84 is less likely to roll or flop over.

Figure 33:
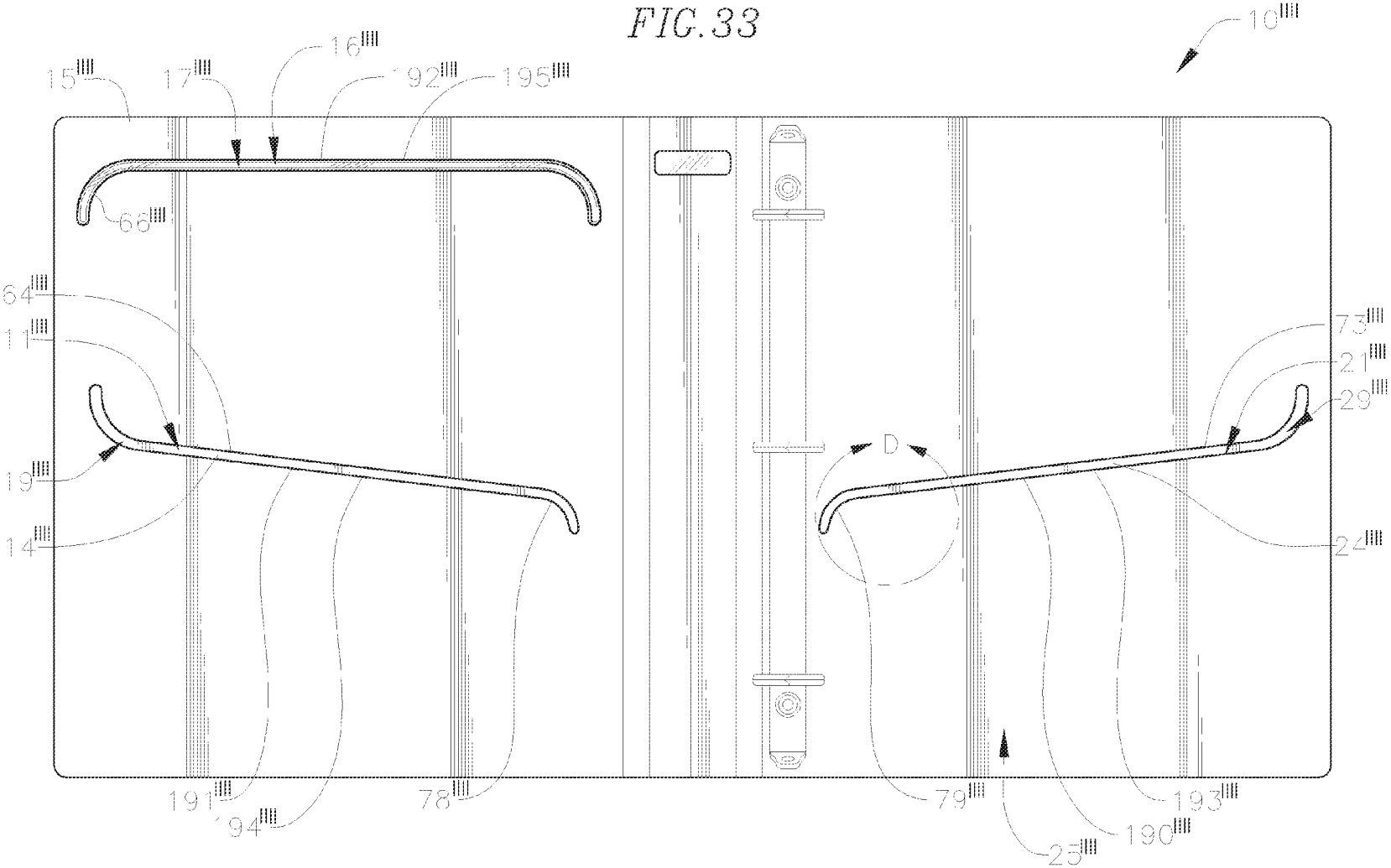
FIG. 33 is a front plan view of the binder of FIG. 10 according to another embodiment of the invention.
Figure 34:
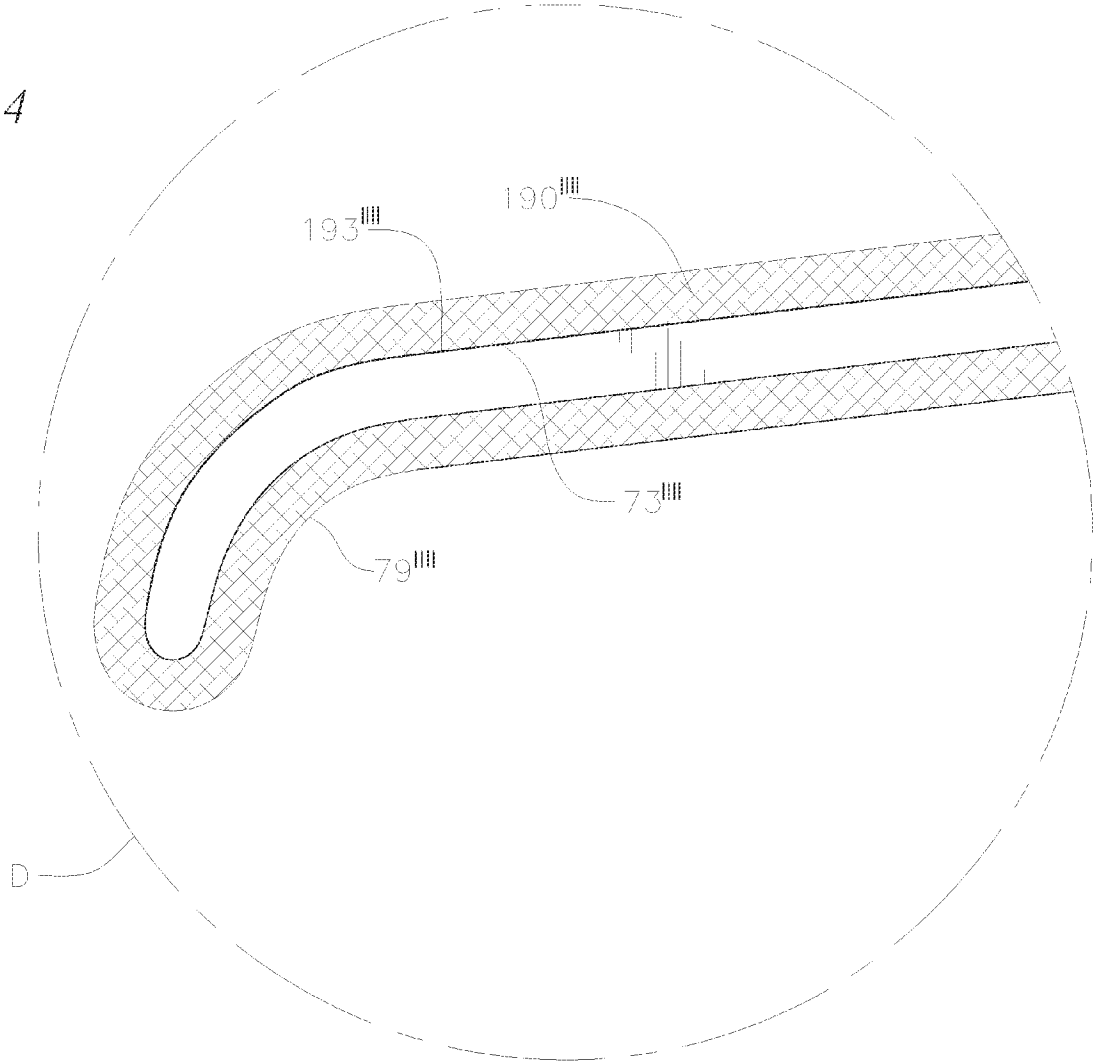
FIG. 34 is a partial close-up view of the circled portion D of the interior opening of the binder of FIG. 33.

As shown in FIG. 33, interior openings 19"" and 29"" of a binder 10"" can also each have an edge or perimeter (e.g., a peripheral edge 64"" and a peripheral edge 73"", respectively) that is embossed. Additionally, an interior opening 17"" through a front cover interior layer 15"" can have a peripheral edge 66"" that is embossed. A close-up view of the circled portion D of FIG. 33 showing embossing 190"" of the peripheral edge 73"" is shown in FIG. 34. As shown in FIG. 33, embossing 191"" and 190"" of the peripheral edges 64"" and 73"", respectively, provides a visual cue for spotting respective interior pockets 11"" and 21"", making it easier for a user to identify and load the interior pockets 11"" and 21"". The embossing 192"" of the peripheral edge 66"" provides a visual cue for spotting the interior opening 17"", making it easier for a user to identify the interior opening 17"" and load an exterior pocket 16"". Additionally, the embossing 191"", 192"", and 190"" of the peripheral edges 64"", 66"", and 73"", respectively, further prevents or reduces the likelihood of "blocking," which is described in more detail above. For example, the embossing 191"" of the peripheral edge 64"" further reduces the likelihood that the front cover interior layer 15"" will stick (or adhere) to a front cover base plate 14"", and the embossing of the peripheral edge 73"" further reduces the likelihood that the back cover interior layer 25"" will stick (or adhere) to a back cover base plate 24"". As a result of the embossing 190"", 191"", and 192"", the embossed portions of the front cover interior layer 15"" and the back cover interior layer 25"" are thinner than the other portions of the front cover interior layer 15"" and the back cover interior layer 25"", which reduces or eliminates the amount of contact between the embossing 190, 191**, and 192** and the front cover base plate 14** or the back cover base plate 24**, thereby further preventing or reducing blocking of the peripheral edges 64**, 66**, and 73****.

The embossing 191 and 190** of the peripheral edges 64** and 73**, respectively, can also put a slight curl 194** and a slight curl 193** along the entirety of each of the peripheral edges 64** and 73** of the interior openings 19** and 29**, respectively, which lifts a portion of the interior layer 4** off of the base plates 14** and 24**, respectively, and makes it easier to insert items (e.g., items 83 and 84 shown in FIG. 28) into the respective interior pockets 11** and 21**. The embossing 192** can also put a slight curl 195** in along the entirety of the peripheral edge 66**. In some embodiments, the curl 194** is more pronounced at a curved portion 78**, and the curl 193** is more pronounced at a curved portion 79**. For example, the peripheral edge 64** of the front cover interior opening 19** can be embossed such that the curved portion 78** of the front cover interior layer 15** bends away from the front cover base plate 14**, and the peripheral edge 73** of the back cover interior opening 29 can be embossed such that the curved portion 79** of the back cover interior layer 25** bends away from the back cover base plate 24**. The curls 194** and 193** in each of the above-described curved portions 78** and 79** can facilitate insertion of material (e.g., items 83 and 84, respectively) into the interior pockets 11** and 21** such that a user can load an item(s) into the interior pocket 11** or 21** using only one hand. The above-described curls 194** and 193** in the curved portions 78** and 79** can make it easier for a user to pick up the curved portion 78** of the front cover interior layer 15** or the curved portion 79** of the back cover interior layer 25** and fold back the curved portion 78** or the curved portion 79**, as described above. The embossing 191**, 192**, and 190** in the peripheral edges 64**, 66**, and 73**, respectively, can be created using a radio frequency (RF) welding or heat sealing machine, and the embossing 191*** and 190** can be created concurrently (or simultaneously or pseudo-simultaneously) with the creation of the interior openings 19** and 29****, which can also be created using the same RF welding machine.

Figure 31:
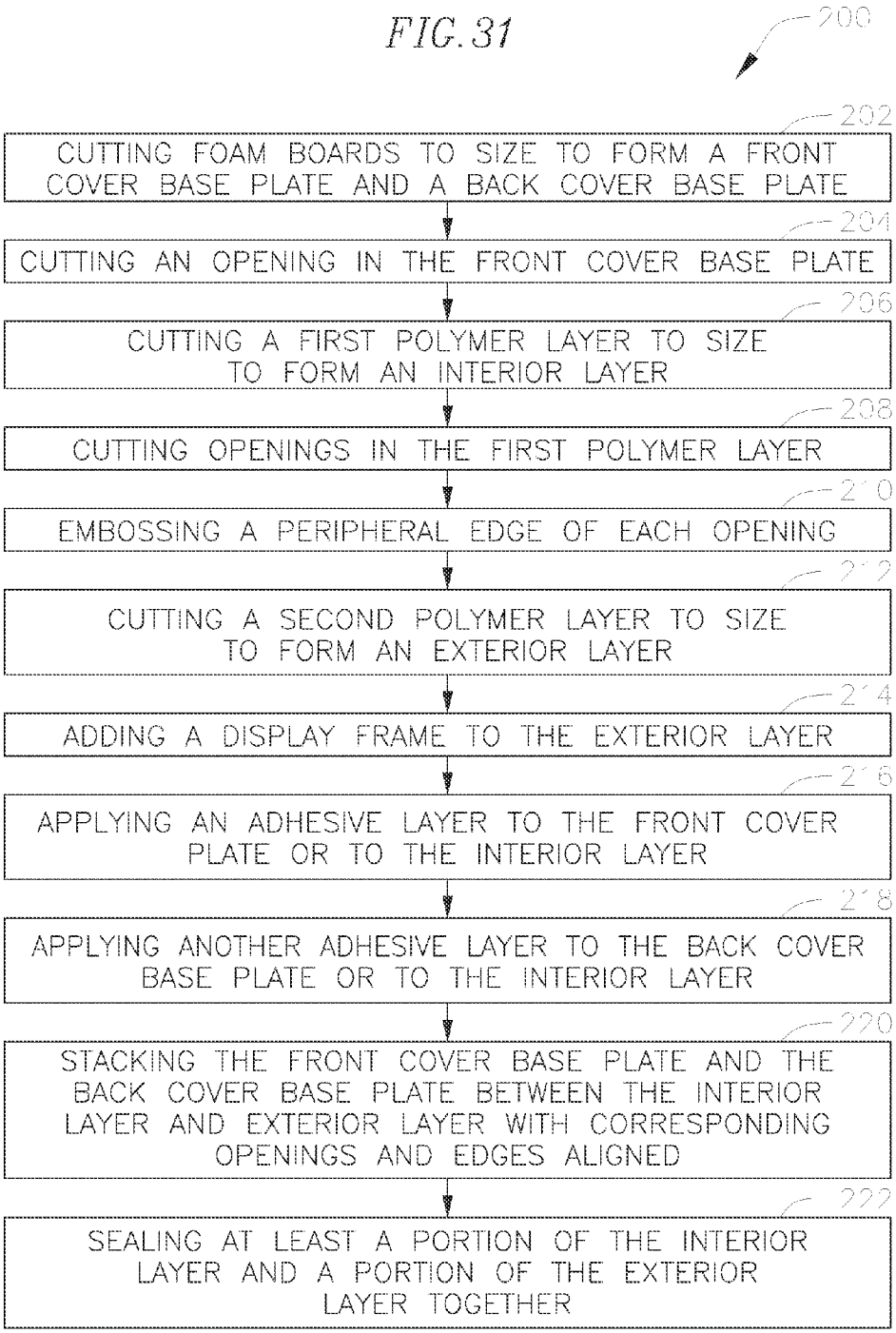
FIG. 31 is a flow chart showing a method of manufacturing a binder according to an embodiment of the invention.

Embodiments of the present invention are also directed to methods of manufacturing a binder 10 or a spine 32 for a binder 10. For example, FIG. 31 shows a flowchart for a method 200 including a step 202 of cutting foam boards (e.g., the foamed polymer layer 114 and the outer skins 113 and 115) to size to form a front cover base plate 14 and a back cover base plate 24. The method 200 can further include a step 204 of cutting an opening (e.g., an interior opening 17) through the front cover base plate 14. The method 200 can also include a step 206 of cutting a first polymer layer to size to form an interior layer 4. The method 200 can further include a step 208 of cutting openings (e.g., interior openings 17, 19, and 29) in the first polymer layer (e.g., the interior layer 4). The method 200 can also include a step 210 of embossing a peripheral edge of each opening (e.g., embossing each of the peripheral edges 66, 64**, and 73** of the interior openings 17**, 19**, and 29**, respectively). The method 200 can further include a step 212 of cutting a second polymer layer to size to form an exterior layer 6. In the methods described above and below, the steps of cutting can be done in any order. For example, in the method 200 described above, the step 202 of cutting foam boards to size to form a front cover base plate 14 and a back cover base plate 24, and the step 204 of cutting an opening through the front cover base plate 14** can be done in any order and can be done concurrently (or simultaneously) with one another.

Figure 32A:
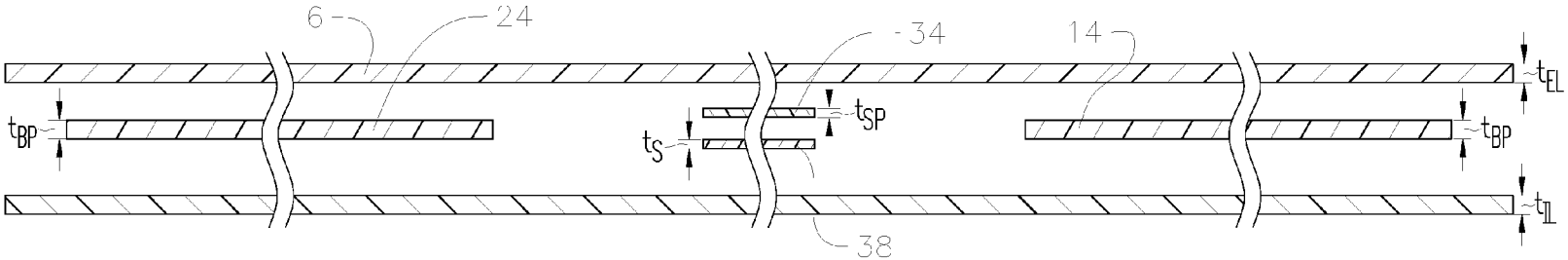
FIGS. 32A-32C are cross-sectional views of the binder of FIG. 16 cut along the line IV-IV' at certain stages of a method of manufacturing the binder according to an embodiment of the invention.
Figure 32B:
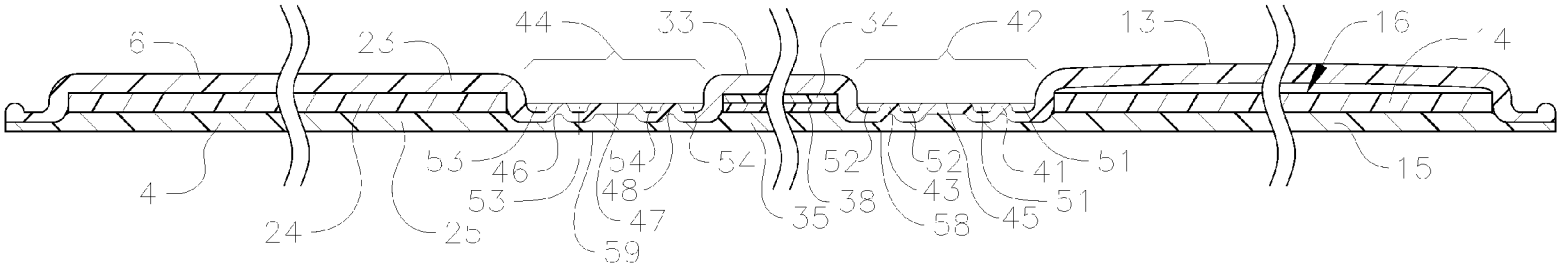
Figure 32C:
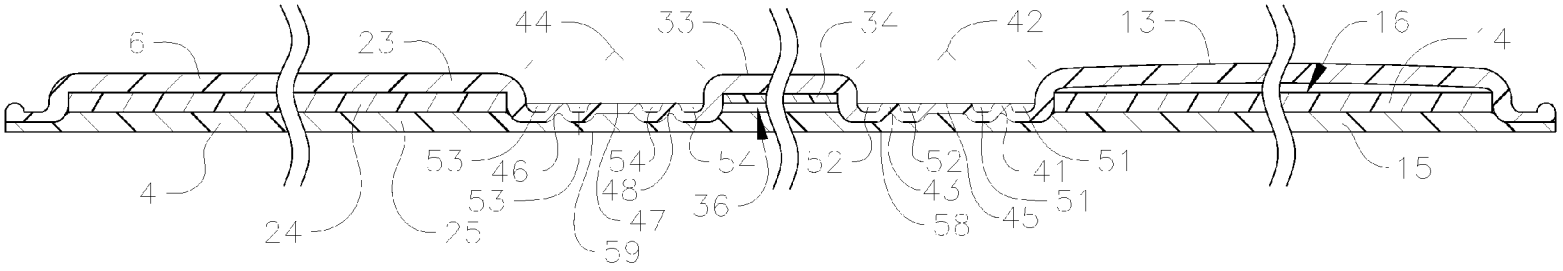

As shown in FIG. 31, the method 200 can further include a step 214 of adding a display frame 30 to the exterior layer 6. The method 200 can also include a step 216 of applying an adhesive layer (e.g., the adhesive layer 18 and/or 118) to the front cover base plate 14 or the interior layer 6. The method 200 can further include a step 218 of applying another adhesive layer (e.g., the adhesive layer 28) to the back cover base plate 24 or the interior layer 4. The method 200 can also include a step 220 of stacking the front cover base plate 14 and the back cover base plate 24 between the interior layer 4 and the exterior layer 6. The method 200 can also include a step 222 of sealing at least a portion of the interior layer 4 and the exterior layer 6 together. For example, FIG. 32A is a cross-sectional view showing one embodiment of the above-described step 220 of stacking the front cover base plate 14 and the back cover base plate 24 between the interior layer 4 and the exterior layer 6, as well as stacking the spine panel 34 and spacer 38 between the interior layer 4 and the exterior layer 6. FIGS. 32B and 32C are cross-sectional views showing the resultant binder 10 of FIG. 16 cut along the line IV-IV', formed after sealing the layers stacked in FIG. 32A. FIG. 32B shows the binder 10 before the removal of the spacer 38, and FIG. 32C shows the binder 10 after the removal of the spacer 38 to form the spine pocket 36. FIGS. 32B and 32C also show the first and second hinges 42 and 44, the first and second vertical ridges 45 and 47, the diagonal ridges 41, 43, 46, and 48, and the valleys 51, 52, 53, and 54. Not all embodiments of the above-described method will include all of the steps described, as some of the steps may be unnecessary.

As discussed above, and shown in FIG. 32B in some embodiments, the interior layer 4 is a single continuous layer including a front cover interior layer 15, an interior surface 58 of a first hinge 42, a spine interior layer 35, an interior surface 59 of a second hinge 44, and a back cover interior layer 25, and the exterior layer 6 is a single interconnected layer including a front cover exterior layer 13, a first hinge 42 including a vertical ridge 45 and diagonal ridges 41 and 43, a spine exterior layer 33, a second hinge 44 including a vertical ridge 47 and diagonal ridges 46 and 48, and a back cover exterior layer 23. Referring back to FIG. 1, in some embodiments, the front cover interior layer 15 includes an interior opening 17 to an exterior pocket 16 and a front cover interior opening 19 to a front cover interior pocket 11, and the back cover interior layer 25 includes a back cover interior opening 29 to a back cover interior pocket 21. As described above, and referring to FIG. 33, the method 200 can further include embossing the openings 17, 19, and 29, such as the peripheral edge 66 of the interior opening 17, the peripheral edge 64 of the front cover interior opening 19, and the peripheral edge 73 of the back cover interior opening 29. In some embodiments, the exterior layer 6 and the interior layer 4 each include EPPE or a blend thereof.

Figure 35A:
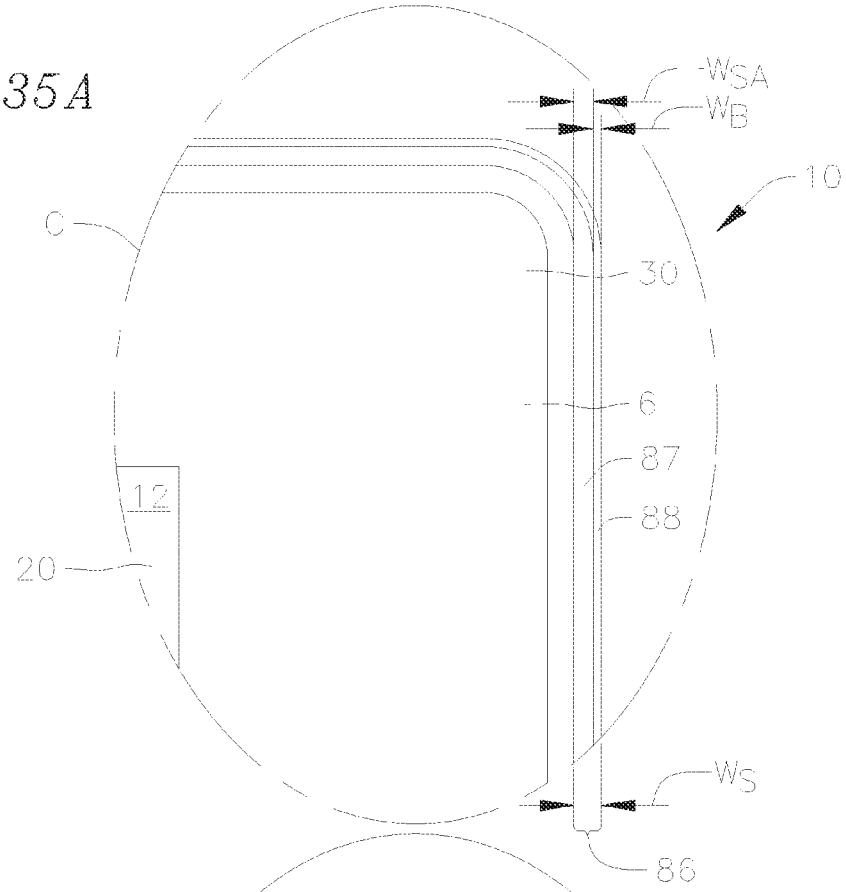
FIG. 35A is a partial close-up view of the circled portion C of the seal of the binder of FIG. 16.
Figure 35B:
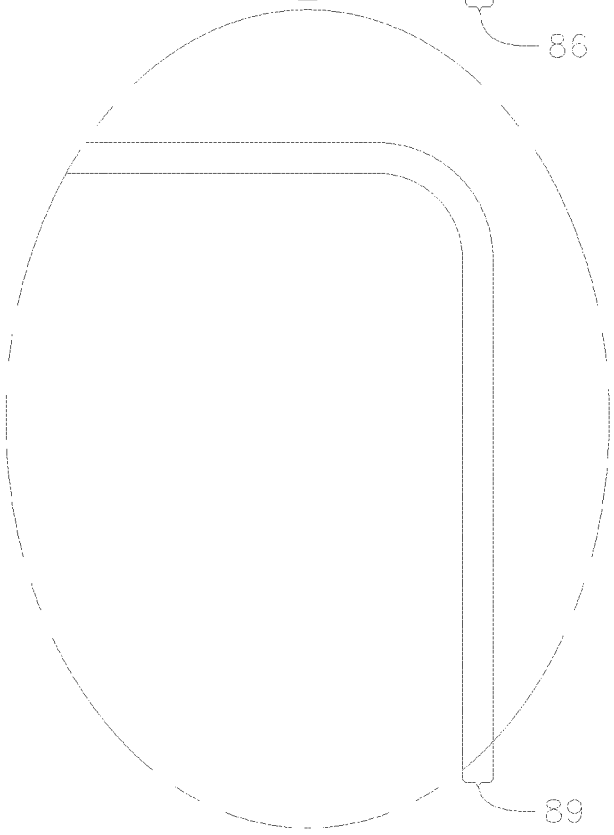
FIG. 35B PRIOR ART
FIG. 35B is a partial close-up view of a traditional seal.

The sealing can be performed using any suitable method such as, for example, Radio Frequency (RF) welding, heat sealing, or ultrasonic welding. RF welding can be performed using any commercially available RF welding machine. As shown in FIG. 35A, according to some embodiments of the invention, the sealing can form a seal 86 including the seal area 87 and the bumper bead 88. FIG. 35A is a close-up view of a circled portion C of FIG. 16. As shown in FIG. 35A, the seal 86 can have a width $w_S$ in a range of about 1 to about 3 mm, for example, about 2 mm. The seal area 87 can have a width $w_{SA}$ in a range of about 0.5 to about 1.5 mm, for example, about 1 mm, and the bumper bead 88 can have a width $w_B$ in a range of about 0.5 to about 1.5 mm, for example, about 1 mm. In contrast, FIG. 35B shows a seal 89 of a traditional binder, in which the traditional seal 89 has a total width of only about 1 mm. As such, a binder according to embodiments of the invention can have a seal 86 having a width $w_S$ that is about 2 times the width of the traditional seal 89 of the binder shown in FIG. 35B.

By having an increased width $W_s$ as compared to a traditional binder seal, the seal 86 according to some embodiments of the invention effectively provides a spring to absorb impact shock, thereby improving the durability of the binder. For example, the increased area of the seal 86 provides more material (relative to a binder having a traditional seal) that can be compressed upon impact, which provides increased shock absorption (relative to a binder having a traditional seal) and reduces the amount of damage that would otherwise result to the corners (e.g., the outer corners 124 and 126 shown in FIG. 3, and the outer corners 132 and 134 shown in FIG. 7) or edges (e.g., the edges 2, 3, and 5 shown in FIG. 1) from impact. Binder corners (e.g., the outer corners 124, 126, 132, and 134) can be particularly susceptible to impact damage, and thus, the increased shock absorption of a binder according to some embodiments of the invention can result in a binder 10 having outer corners 124, 126, 132, and 134 that are more durable than the corners of a binder having a traditional seal.

Additionally, the above-described seal 86 (including seal area 87 and bumper bead 88) is particularly compatible with materials such as EPPE (or a blend thereof, such as a blend of EPPE and ethylene vinyl acetate) at the above-described widths. Although the above-described sealing and embossing can be accomplished using RF welding, the resulting seal and embossing can be different from one another, even if the sealing and embossing are performed using the same machine. For example, the embossing can be performed on a single layer (e.g., the interior layer 4) while the sealing can be used to bond two layers (e.g., the interior layer 4 and the exterior layer 6) together. Embossing a single layer (e.g., the interior layer 4) produces a different result than does sealing two layers (e.g., the interior layer 4 and the exterior layer 6) together.

Figure 27:
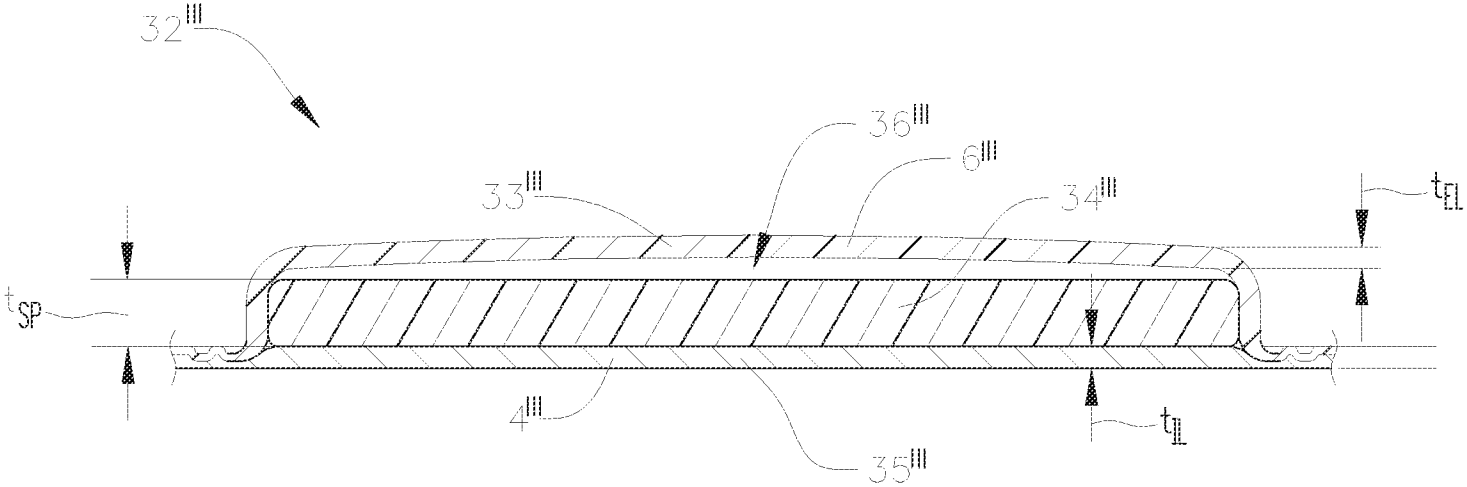
FIG. 27 is a fragmentary cross-sectional view of another embodiment of the spine of the binder of FIG. 5 cut along the line II-II'.
Figure 36:
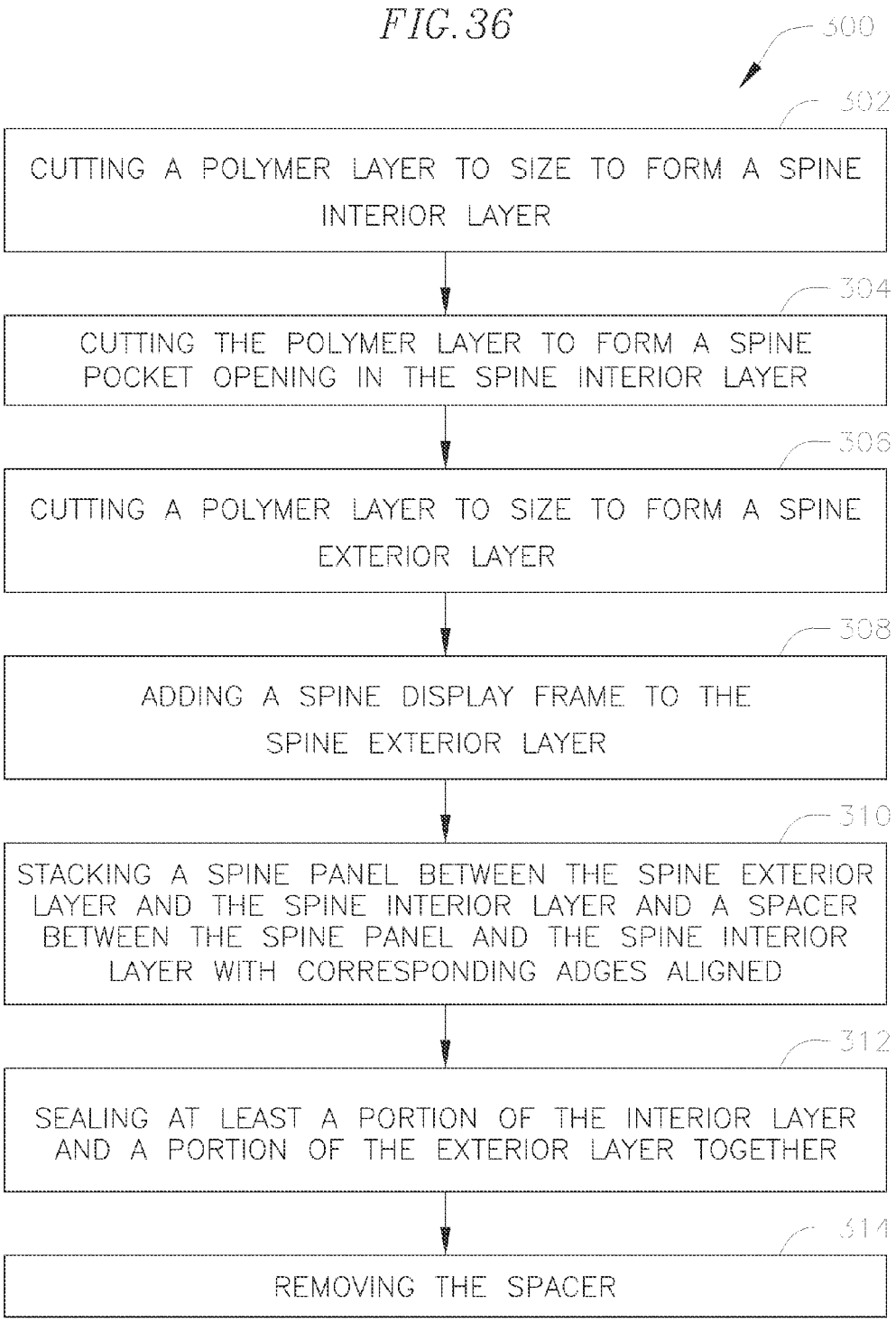
FIG. 36 is a flow chart showing a method of manufacturing a spine for a binder according to an embodiment of the invention.
Figure 37:
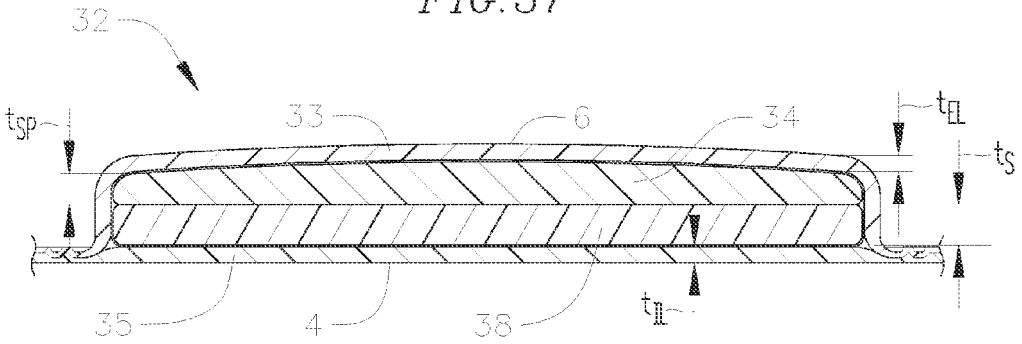
FIG. 37 is a cross-sectional view of the spine for the binder of FIG. 5 cut along the line II-II' before a spacer has been removed from the spine pocket.
Figure 38:
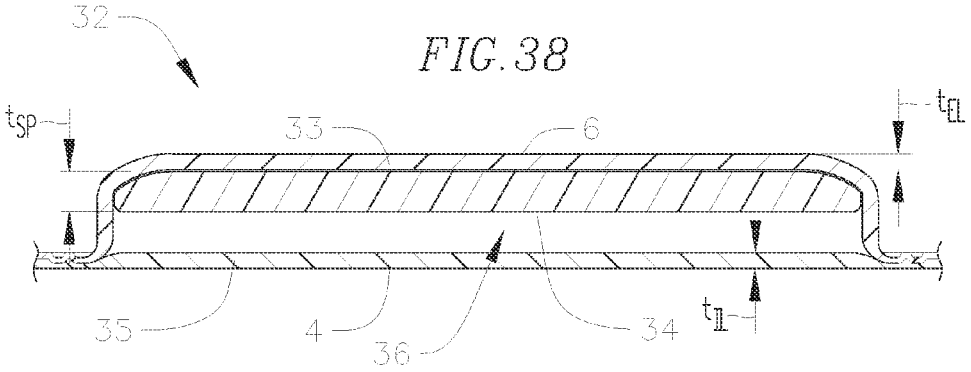
FIG. 38 is a cross-sectional view of the spine for the binder of FIG. 5 cut along the line II-II' after the spacer has been removed from the spine pocket.

Some embodiments of the invention also include a method 300 (shown in FIG. 36) of manufacturing a spine 32 for a binder 10. For example, as shown in FIG. 36 (and referring back to FIG. 1), a method 300 of manufacturing a spine 32 for a binder 10 can include a step 302 of cutting a polymer layer to size to form a spine interior layer 35. The method can also include a step 304 of cutting the polymer layer to form a spine pocket opening 39 in the spine interior layer 35. The method 300 can further include a step 306 of cutting a polymer layer to form a spine exterior layer 33. The method 300 can also include a step 308 of adding a spine display frame 30 to the spine exterior layer 33. The method 300 can further include a step 310 of stacking a spine panel 34 between the spine exterior layer 33 and the spine interior layer 35, and stacking a spacer 38 between the spine panel 34 and the spine interior layer 35 with corresponding edges aligned. The method 300 can also include a step 312 of sealing at least a portion of the spine exterior layer 33 and at least a portion of the spine interior layer 35 together. The method can further include a step 314 of removing the spacer 38. In some embodiments, the spacer 38 is removed through the spine interior opening 39 (shown in FIG. 1). FIG. 37 shows the spacer 38 between the spine panel 34 and the spine interior layer 35, and FIG. 38 shows spine 32 after the spacer 38 has been removed. As shown in FIG. 38, once the spacer 38 has been removed, a spine pocket 36 remains between the spine interior layer 35 and the spine panel 34. The spacer 38 can have a thickness $t_S$ in a range of about 1.5 mm to about 3 mm, for example, about 2 mm. In an alternative embodiment, the spacer 38 can be stacked between the spine exterior layer 33 and the spine panel 34, at least a portion of the spine exterior layer 33 and a portion of the spine interior layer 35 can be sealed together, and the spacer 38 can be removed through the spine interior opening 39. According to that embodiment, once the spacer 38 has been removed through the spine interior opening 39, the spine pocket 36 remains between the spine exterior layer 33 and the spine panel 34, as shown in FIG. 27. As described above, the spacer 38 facilitates the formation of the spine pocket 36. By forming the spine 32 using the spacer 38, the spine pocket 36 can be made larger making it easier for a user to load items (e.g., item 82) into the spine pocket 36. Not all embodiments of the above-described method will include all of the steps described, as some of the steps may be unnecessary.

Figure 39:
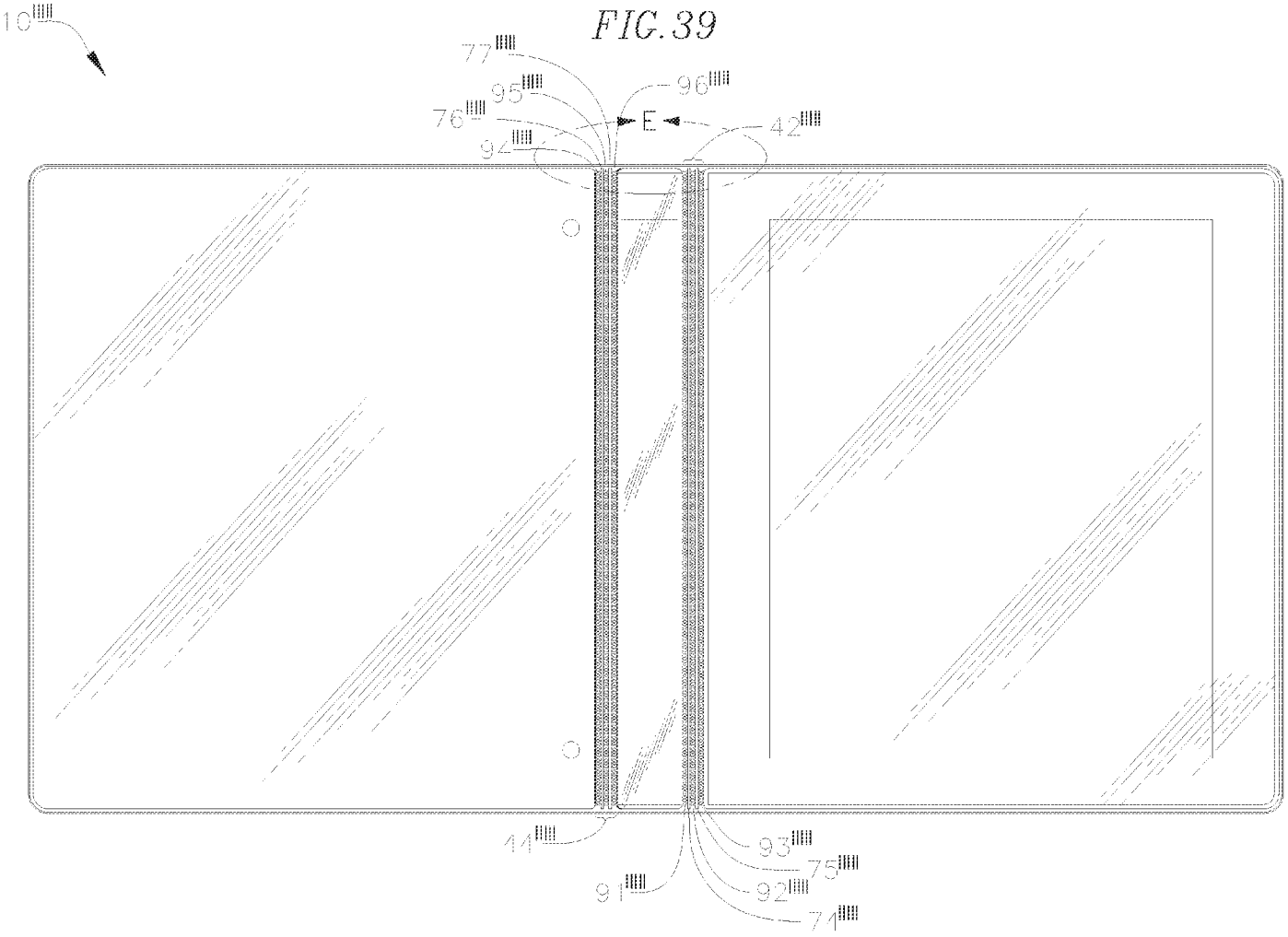
FIG. 39 is a back view of the exterior of a binder according to another embodiment of the invention.
Figure 40:
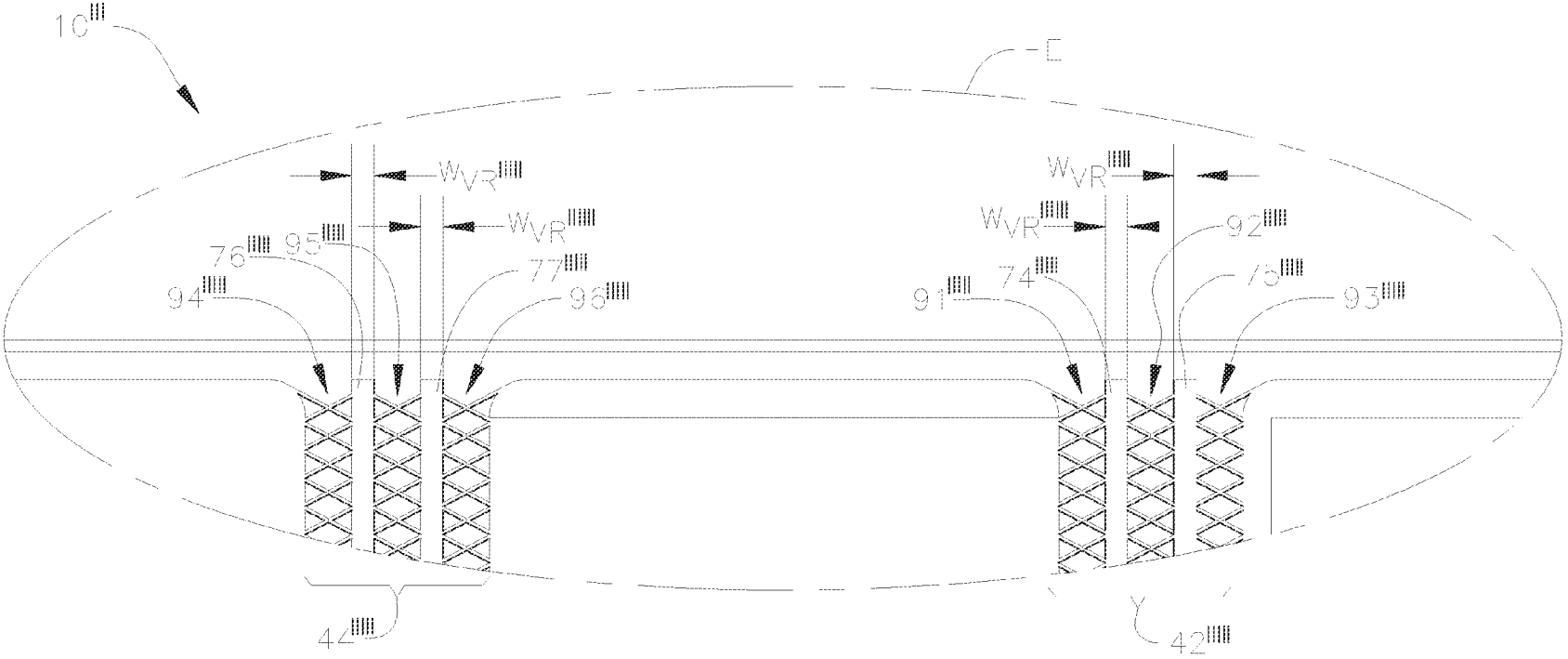
FIG. 40 is a partial close-up back view of the circled portion E of the top of the exterior of the binder of FIG. 39.

The above-described hinges 42 and 44 can be formed by using a two-bar seal (e.g., a two bar score), such as the seal shown in FIGS. 17 and 18. In alternative embodiments, first and second hinges 42''' and 44''' may be formed using a three-bar seal (e.g., a three-bar score). For example, FIGS. 39 and 40 show the first and second hinges 42'''''' and 44'''''' of a binder 10'''''' formed using a three-bar seal. FIG. 40 is close-up view of a circled portion E of FIG. 39. As shown in FIGS. 39 and 40, the first hinge 42'''''' includes a first vertical ridge 74'''''', a second vertical ridge 75'''''', and cross-hatch ridges 91'''''', 92'''''', and 93'''''', and the second hinge 44'''''' includes a first vertical ridge 76'''''', a second vertical ridge 77'''''', and cross-hatch ridges 94'''''', 95'''''', and 96''''''. The vertical ridges 75'''''' and 76'''''' can each independently have a width $w_{VR''''''}$ in a range of about 0.5 mm to about 1.5 mm, for example about 1 mm. The vertical ridges 74 and 77 can each independently have a width $w_{VR''''''}$ in a range of about 0.5 mm to about 1.5 mm, for example about 1 mm.

Figure 41:
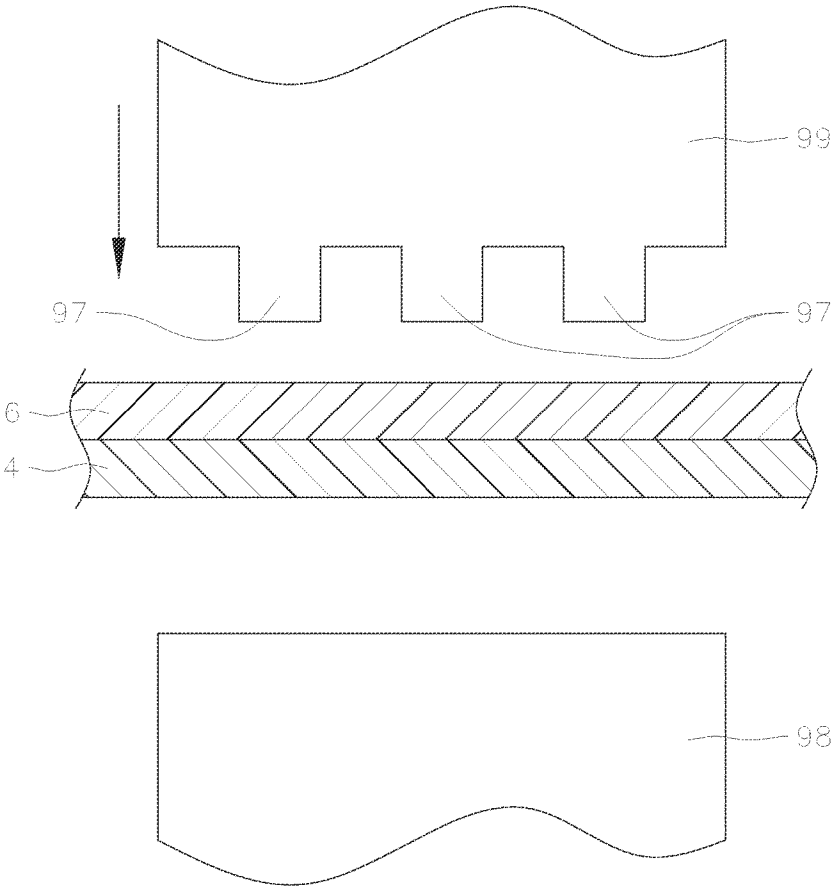
FIG. 41 is a schematic cross-sectional view of a three-bar seal machine for sealing layers together.
Figure 42:
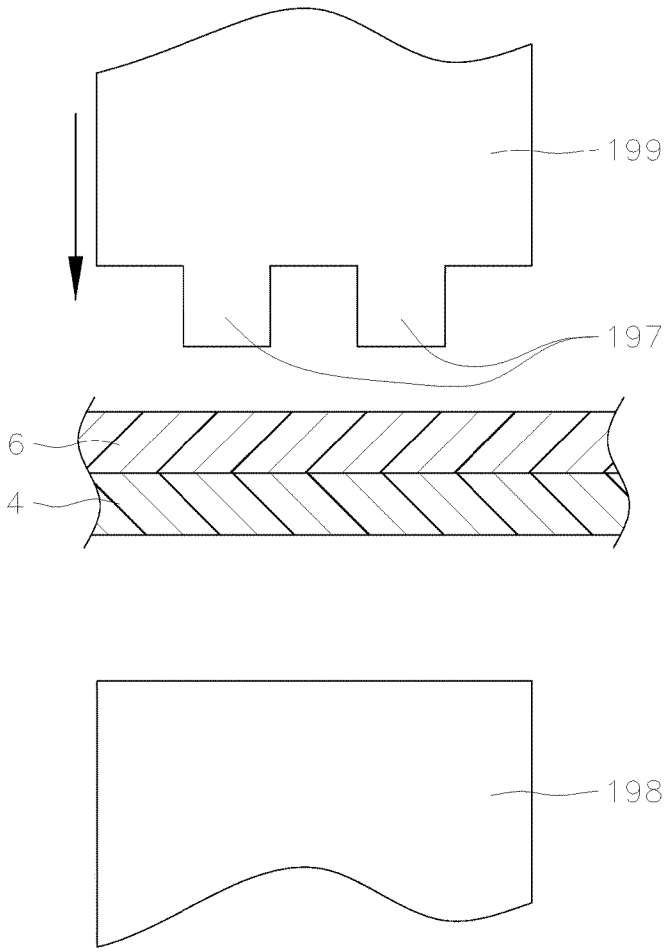
FIG. 42 is a schematic cross-sectional view of a two-bar seal machine for sealing layers together.

FIG. 41 is a schematic cross-sectional view of a three-bar seal machine that can be used to form a three-bar seal (e.g., the first and second hinges 42'''''' and 44'''''' described above). The three-bar seal machine includes a platen 98 and a three-bar seal 99 including three bars 97. As shown in FIG. 41, the three-bar seal hinges 42'''''' and 44'''''' described above can be formed by pressing the interior layer 4 and the exterior layer 6 between the platen 98 and the three-bar seal 99, and welding (e.g., RF welding). FIG. 42 is a schematic cross-sectional view of a two-bar seal machine that can be used to form a two-bar seal (e.g., the first and second hinges 42 and 44 described above). The two-bar seal machine includes a platen 198 and a two-bar seal 199 including two bars 197. As shown in FIG. 42, the two-bar seal hinges 42 and 44 described above can be formed by pressing the interior layer 4 and the exterior layer 6 between the platen 198 and the two-bar seal 199, and welding (e.g., RF welding).

While the present invention has been described in connection with certain exemplary embodiments, it is to be understood that the invention is not limited to the disclosed embodiments, but, on the contrary, is intended to cover various modifications and equivalent arrangements included within the spirit and scope of the appended claims, and equivalents thereof.

What is claimed is:

1. A binder comprising:

a front cover including:

a front cover exterior layer;
a front cover interior layer;
a front cover base plate between the front cover exterior layer and the front cover interior layer;
an exterior pocket formed between the front cover exterior layer and the front cover base plate;
a back cover and a spine coupled between the front cover and the back cover, wherein:
the back cover includes a back cover exterior layer,
the spine includes a spine exterior layer, and each of the front cover exterior layer,
the back cover exterior layer and the spine exterior layer include a polymer layer;
a first hinge coupled between the front cover and a spine and a second hinge coupled between a back cover and the spine;
the first hinge includes an exterior layer sealed to an interior layer and includes a vertical ridge and at least two columns of ridges; and
an interior opening to the exterior pocket formed through the front cover interior layer and the front cover base plate wherein a portion of the front cover base plate is configured to be visible when the binder is an open position.

2. The binder of claim 1, wherein the front cover base plate is a color that is different from that of the front cover interior layer.

3. The binder of claim 1, wherein the spine further includes:
a spine interior layer;
a spine panel between the spine exterior layer and the spine interior layer;
a spine pocket between the spine panel and the spine interior layer; and
a spine interior opening to the spine pocket formed through the spine interior layer.

4. The binder of claim 3, wherein the spine pocket is configured to contain an item so that the item is at least partially visible through the spine exterior layer.

5. A binder comprising:
a front cover including:
a front cover exterior layer;
a front cover interior layer;
a back cover; and
a spine coupled between the front cover and the back cover, the spine includes:
a spine interior layer;
a spine panel between the spine exterior layer and the spine interior layer;
a spine pocket between the spine panel and the spine interior layer; and
a spine interior opening to the spine pocket formed through the spine interior layer;
wherein:
a first hinge coupled between the front cover and the spine and a second hinge coupled between the back cover and the spine;
the first hinge includes an exterior layer sealed to an interior layer and includes a vertical ridge and at least two columns of ridges.

6. The binder of claim 5, wherein the ridges of the at least two columns of ridges of the first hinge are diagonal ridges.

7. The binder of claim 6, wherein:
the first hinge includes a vertical ridge and at least two columns of ridges;
the second hinge includes a vertical ridge and at least two columns of ridges;
the ridges of the at least two columns of ridges of the first hinge are diagonal ridges; and
the ridges of the at least two columns of ridges of the second hinge are diagonal ridges.

8. The binder of claim 7, wherein the ridges of the at least two columns of ridges of the first hinge are horizontal ridges.

9. The binder of claim 5, wherein:
the first hinge includes a vertical ridge and at least two columns of ridges;
the second hinge includes a vertical ridge and at least two columns of ridges;
the ridges of the at least two columns of ridges of the first hinge are horizontal ridges; and
the ridges of the at least two columns of ridges of the second hinge are horizontal ridges.

10. The binder of claim 5, wherein: the first hinge includes a vertical ridge and at least two columns of ridges, the second hinge includes a vertical ridge and at least two columns of ridges, and the columns of ridges of the first hinge and the second hinge each include a plurality of valleys between the respective ridges of each column of ridges.

11. The binder of claim 10, wherein a ratio of a total area of the plurality of valleys of the first hinge to a total area of the first hinge is in a range of about 28% to about 32%, and a ratio of a total area of a total area of the plurality of valleys of the second hinge to a total area of the second hinge is in a range of about 28% to about 32%.

12. The binder of claim 11, wherein the ratio of the total area of the vertical ridge and the plurality of ridges of the first hinge to the total area of the plurality of valleys of the first hinge is about 30%, and the ratio of the total area of the vertical ridge and the plurality of ridges of the second hinge to the total area of the plurality of valleys of the second hinge is about 30%.

13. The binder of claim 5, further comprising a front cover base plate between the front cover exterior layer and the front cover interior layer.

14. The binder of claim 13, further comprising an interlayer between the front cover exterior layer and the front cover base plate wherein the interlayer is a support layer.

* * * * *